US008216758B2

(12) United States Patent
Yamada et al.

(10) Patent No.: US 8,216,758 B2
(45) Date of Patent: Jul. 10, 2012

(54) TONER, DEVELOPER, DEVELOPING DEVICE, AND IMAGE FORMING APPARATUS

(75) Inventors: Saori Yamada, Osaka (JP); Yoshitaka Kawase, Osaka (JP); Yoshiaki Akazawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 470 days.

(21) Appl. No.: 12/474,678

(22) Filed: May 29, 2009

(65) Prior Publication Data

US 2009/0297225 A1 Dec. 3, 2009

(30) Foreign Application Priority Data

May 29, 2008 (JP) ..... 2008-141580

(51) Int. Cl.
*G03G 9/00* (2006.01)

(52) U.S. Cl. ..... 430/110.2; 430/108.1; 430/108.6; 430/110.3

(58) Field of Classification Search ..... 430/108.1, 430/108.6, 108.7, 110.1, 110.2, 110.3, 111.1
See application file for complete search history.

(56) References Cited

U.S. PATENT DOCUMENTS

| | | | | |
|---|---|---|---|---|
| 4,915,987 | A | 4/1990 | Nara et al. | |
| 5,296,266 | A | 3/1994 | Kunugi et al. | |
| 5,948,582 | A * | 9/1999 | Nakamura et al. | 430/110.3 |
| 5,976,755 | A | 11/1999 | Yoshida et al. | |
| 6,686,112 | B2 | 2/2004 | Teshima et al. | |
| 2007/0042285 | A1 | 2/2007 | Kitani et al. | |
| 2008/0096116 | A1 | 4/2008 | Utsumi et al. | |
| 2009/0297224 | A1 | 12/2009 | Kawase | |

FOREIGN PATENT DOCUMENTS

| | | | |
|---|---|---|---|
| CN | 1203384 | | 12/1998 |
| EP | 1 380 900 | A1 | 1/2004 |
| JP | 4-211269 | | 8/1992 |
| JP | 4-311965 | | 11/1992 |
| JP | 5-10971 | | 2/1993 |
| JP | 11-015206 | | 1/1999 |
| JP | 11-095478 | | 4/1999 |
| JP | 2001-324831 | | 11/2001 |
| JP | 2002-207321 | | 7/2002 |
| JP | 3372698 | | 2/2003 |
| JP | 2006-47743 | A | 2/2006 |
| JP | 2007-57575 | A | 3/2007 |
| JP | 11-095478 | | 4/2009 |

* cited by examiner

*Primary Examiner* — Mark F Huff
*Assistant Examiner* — Stewart Fraser
(74) *Attorney, Agent, or Firm* — Nixon & Vanderhye P.C.

(57) ABSTRACT

A toner whose flowability, chargeability and fixing property are enhanced, a developer, a developing device and an image forming apparatus are provided. The toner comprises a toner particle in which a shell layer is formed on a surface of a core particle, and external additive, where (1) the shell layer is formed in a film on the surface of the core particle, (2) a shape factor SF-2 is 120 or more and 140 or less, and (3) a BET specific surface area measured by the BET method is 1.2 $m^2/cm^3$ or more and 4.0 $m^2/cm^3$ or less. The developer containing such a toner is filled into the developing device in the image forming apparatus in order to form an image.

7 Claims, 3 Drawing Sheets

TONER, DEVELOPER, DEVELOPING DEVICE, AND IMAGE FORMING APPARATUS

CROSS-REFERENCE TO RELATED APPLICATION

This application claims priority to Japanese Patent Application No. 2008-141580, which was filed on May 29, 2008, the contents of which are incorporated herein by reference in their entirety.

BACKGROUND OF THE INVENTION

1. Field of the Invention

The present invention relates to a toner, which is used to develop an electrostatic latent image in an electrophotographic method or electrostatic printing method, a developer including the toner, and a developing device and an image forming apparatus, which use the developer.

2. Description of the Related Art

A toner is used to visualize an electrostatic latent image in various image forming processes, and one known example thereof is an electrophotographic image forming process.

In an electrophotographic image forming apparatus, an image is formed by way of the respective steps of charging, exposure, developing, transferring, and fixing. First of all, in the charging step, a surface of a photoreceptor is uniformly charged, which photoreceptor serves as an image bearing member on which an electrostatic latent image is to be formed. In the exposure step, the charged surface of the photoreceptor is irradiated with light corresponding to image information so that the electrostatic latent image is formed on the surface of the photoreceptor. In the developing step, a black toner for example is attached optionally to the electrostatic latent image formed as above in order to form an image visualized with the toner (toner image) on the surface of the photoreceptor. Then, in the transferring step, the toner image is transferred onto a recording medium by electrical attraction. In case of an intermediate transfer process, the toner image is transferred onto a recording medium from an intermediate transfer member. In the final fixing step, the toner image transferred on the recording medium is molten by heat and pressured so as to be fixed on the recording medium.

As a color imaging technique has been rapidly advanced in such an electrophotographic process, a full-color image forming apparatus has been developed and now available in the market. The market scale of the full-color image forming apparatus expands according as the black-and-white image forming apparatus prevails. In reproducing colors. In the full-color image forming apparatus, it is common to use a toner in, for example, three subtractive primary colors; yellow (Y), magenta (M), and cyan (C), or tour colors composed of the above three colors and black (K). The colors are reproduced in the following procedures. Among the image forming steps, the steps of charging, exposure, developing, and transferring, are repeated. For the respective colors of C, N, Y, and K so that the toner images made of the toner of the plural colors overlap one another on a recording medium, thus forming a full-color image. Then, in the final fixing step, the above overlapping toner images are molten so as to be fixed on the recording medium. In the procedure just described, the overlapping toner images are molten so as to be mixed with each other, with the result that the colors are reproduced based on the subtractive principles.

In such a full-color electrophotographic method, development is carried out more than once and in the intermediate transferring step, a plurality of toner images different in color from each other are overlaid with one another on the intermediate transfer member, and accordingly expected chargeability, flowability, and fixing property of the toners in respective colors are extremely important factors.

Further, in order to maintain stable and favorable color reproducibility in the full-color images, for example, it is necessary to transfer a predetermined amount of toner need onto an intermediate transfer medium and recording medium from the developing step to the transferring step. An amount of attaching toner in the developing step and the transferring step is greatly influenced by charging properties such as charge rising property of the toner and environmental and temporal stability of a charge amount of toner, and flowability.

In order to improve and adjust chargeability, flowability, transferability and the like, for example, an external additive is added to a toner including a binder resin, a colorant, a charge control agent and the like. As to an amount of addition of the external additive to the toner, when downsizing of a particle size of a toner particle is progressed in order to obtain a high-definition image and thus surface area per unit weight of the toner is increased, the amount of addition thereof per unit weight of the toner tends to be increased. This is because when the surface area per unit weight of the toner is increased, adhesion of the toner is so enhanced that there arises a need to add a large amount of the external additive to maintain flowability. However, in spite of increase of the amount of addition of the external additive per unit weight of the toner, when an external additive is added under the same condition where the amount of addition of the external additive is not increased, a fall-off amount of the external additive which falls off downsized toner particles is more than a fall-off amount of the external additive which falls off non-downsized toner particles. The fallen-off external additive tends to attach to a carrier and a charging member so that the carrier and the charging member are soiled with the fallen-off external additive. When the carrier and the charging member are soiled, degrading of chargeability and filming to the photoreceptor occur.

A fall-off amount of the external additive is so dependent from a particle size in the external additive and an amount of addition thereof that there exists a method of controlling the fall-off amount of the external additive by defining the particle size and the amount of addition. Further, when an external additive is attached to a base particle with mechanical energy by using a mixer or the like, the external additive is restrained from falling off by making a mixing time longer and a circumferential velocity faster, but the external additive tends to migrate to a concave portion in a toner, so that an effect of adding an external additive is not sufficiently obtained.

Further, when a toner is molten on a surface of a recording medium so as to be fixed thereto, an external additive on the toner surface brings the toner so hard to melt that there arises a problem that fix level becomes low etc. Accordingly, it is preferable that the amount of addition of the external additive is small.

As the toner, a pulverized toner is used conventionally but it has an amorphous shape whose surface has a plurality of concavity and convexity. Since fracture plane after pulverization directly becomes the toner surface, surface composition of the toner easily becomes so nonuniform that it is difficult to control the surface condition to be uniform. Unless the surface condition is uniform, the external additive is so hard to uniformly attach to the surface of toner particle that chargeability degrades.

Further, in a toner, release agent having a low melting temperature which is effective to prevent high-temperature offset from being generated, and a low temperature-softening component that is effective to fix at a low temperature may be contained, so that exposure thereof to the toner surface causes problems of degradation of flowability and degradation of chargeability due to spent to a carrier.

Further, when toner have the amorphous shapes whose surfaces have a plurality of concavity and convexity, adhesion is so enhanced that flowability degrades and charge rising is late, with the result that there arises a problem that transfer efficiency lowers.

In view of such problems, Japanese Examined Patent Publication JP-B2 3372698 discloses a toner, in which a value of shape factor SF-1 is $120 \leqq SF\text{-}1 \leqq 160$, a value of shape factor SF-2 is $115 \leqq SF\text{-}2 \leqq 140$, the values being measured by an image analyzer for toner, a relationship between specific surface area Sb ($m^2/cm^3$) per unit volume of the toner measured by the BET method and specific surface area St ($m^2/cm^3$) per unit volume of the toner calculated from an weight average particle size on the assumption that toner are perfect sphere meets $3.0 \leqq Sb/St \leqq 7.0$ and $Sb \geqq St \times 1.5 + 1.5$, and specific surface area Sb is 3.2 to 6.8 ($m^2/cm^3$ ). According to a toner disclosed in JP-B2 3372698, contact area between toner particles, and contact area between toner, and a photoreceptor and an intermediate transfer member are reduced, so that flowability is improved and transfer efficiency and cleaning property are enhanced.

However, a toner disclosed in JP-B2 3372698 includes pulverized toner particles, on which shell layers are not formed, surface composition of the toner particle is nonuniform, and there exists component whose polarity is the same as that of the external additive, so that the external additive easily falls off and thus soiling of a carrier and a charging member is occurred. Further, due to fall-off of the external additive, environmental and long-term stability of a charge amount of the toner is not sufficiently improved. Moreover, in a pulverized toner, degradation of chargeability due to exposure of low melting temperature component and charge instability due to nonuniformity of the surface composition is not improved.

SUMMARY OF THE INVENTION

An object of the invention is to provide a toner whose flowability, chargeability and fixing property are enhanced, a developer, a developing device and an image forming apparatus.

The invention provides a toner comprising:

a toner particle including a core particle and a shell layer formed on a surface of the core particle; and an external additive, (1) the shell layer being formed in a film on the surface of the core particle, (2) a shape factor SF-2 being 120 or more and 140 or less, and (3) a BET specific surface area measured by a BET method being 1.2 $m^2/cm^3$ or more and 4.0 $m^2/cm^3$ or less.

According to the invention, the toner includes a toner particle including a core shell and a shell layer formed on a surface of the core particle, and an external additive, (1) the shell layer being formed in a film on the surface of the core particle, (2) a shape factor SF-2 being 120 or more and 140 or less, and (3) a BET specific surface area measured by a BET method being 1.2 $m^2/cm^3$ or more and 4.0 $m^2/cm^3$ or less.

By forming the shall layer in a film on the surface of the core particle, low melting temperature component such as release agent is not exposed on the surface of the core particle, and component of a surface of the toner particle is uniformed so that the external additive is uniformly attached to the surface of the toner particle so as to restrain the external additive from falling off the toner particle, thereby being capable of enhancing chargeability. Further, there exists no component whose polarity is the same as that of the external additive on the surface of the toner particle, so that the external additive is restrained from falling off the toner particle.

When the shape factor SF-2 of the toner including the external additive is within the above range, it is possible to bring flowability excellent and charge rising favorable. Further, cleaning property is also advanced. When the shape factor SF-2 of the toner is below 120, cleaning property may degrade since the shape of the toner is too spherical. When the shape factor SF-2 is above 140, flowability may degrade since the surface of the toner includes an undesirable large number of concavities and convexities, and thus adhesion of the toner is enhanced.

When a BET specific surface area is within the above range, a fall-off amount of the external additive can be suppressed, with the result that soiling of a carrier and a charging member can be reduced. Accordingly, charge depression of the developer in forming images disappears and occurrence of fogging can be suppressed. Further, fixing inhibition due to the external additive can be suppressed. When a BET specific surface area is below 1.2 $m^2/cm^3$, the external additive has not been added onto the surface of the toner particle, so that flowability may degrade. When a BET specific surface area is above 4.0 $m^2/cm^3$, a large amount of external additive has been added onto the surface of the toner particle. Accordingly, the external additive easily falls off the surface of the toner particle, so that the carrier and the charging member are soiled by the fallen-off external additive, with the result that the charge amount may lower, and fogging may occur. Meanwhile, fixing may be inhibited by the external additive. When the shell layer is formed on the surface of the core particle, the shape factor SF-2 of the toner is 120 or more and 140 or less, and a BET specific surface area is 1.2 $m^2/cm^3$ or more and 4.0 $m^2/cm^3$ or less, the toner with excellent chargeability, fixing property and flowability over a long period of time can be achieved. By using such a toner to form images, favorable images with no fogging or fixing failure can be stably formed over a long period of time.

Further, in the invention, it is preferable that the BET specific surface area is 1.2 $m^2/cm^3$or more and 3.2 $m^2/cm^3$ or less.

According to the invention, the BET specific surface area of the toner is 1.2 $m^2/m^3$ or more and 3.2 $m^2/cm^3$ or less. When the BET specific surface area of the toner is 1.2 $m^2/cm^3$ or more and 3.2 $m^2/cm^3$ or less, it is possible that charge stability is maintained, fixing inhibition due to the external additive is further suppressed, and non-offset region is broadened. Accordingly, favorable images with no fogging or fixing failure can be more stably formed over a long period of time.

Further, in the invention, it is preferable that the core particle has a shape factor SF-1 of 140 or more and 160 or less, and a shape factor SF-2 of 130 or more and 150 or less.

According to the invention, it is preferable that the core particle has a shape factor SF-1 of 140 or more and 160 or less, and a shape factor SF-2 of 130 or more and 150 or less. When the shape factor SF-1 and the shape factor SF-2 of the core particle are within the above range, the toner with excellent cleaning property and flowability can be obtained. When the shape factor SF-1 of the core particle is below 140, the shape of the core particle is too spherical and thus the shape of the toner also tends to be spherical, which toner has been prepared such that the shell layer is formed on the surface of the core particle. Accordingly, cleaning property may degrade. When the shape factor SF-1 of the core particle is above 160, transferability of the toner may degrade, which toner has been prepared such that the shell layer is formed on the surface of the core particle. When the shape factor SF-2 of the core particle is below 130, an amount of concavity and convexity on the surface of the core particle is so small undesirably that cleaning property of the toner may degrade, which toner has been prepared such that the shell layer is formed on the surface of the core particle. When the shape factor SF-2 of the core particle is above 150, flowability of the toner may degrade, which a toner has been prepared such that the shell layer is formed on the surface of the core particle. Accordingly, favorable images with no fogging or fixing failure can be more stably formed over a long period of time.

Further, in the invention, it is preferable that the shell layer is formed on the surface of the core particle within a range of 80% or more and 100% or less of surface area of the core particie.

According to the invention, the shell layer is formed on the surface of the core particle within a range of 80% or more and 100% or less of surface area of the core particle. The shell layer formed within the above range allows exposure of the surface of the core particle to be substantially reduced and surface composition of the toner particle to be further uniformed. Accordingly, the external additive is further uniformly attached to the surface of the toner particle, thereby further advancing chargeability, with the result that favorable images with no fogging or fixing failure can be more stably formed over a long period of time.

Further, in the invention, it is preferable that an average primary particle size of the external additive is 5 nm or more and 200 nm or less.

According to the invention, an average primary particle size of the external additive is 5 nm or more and 200 nm or less. When an average primary particle size of the external additive is 5 nm or more and 200 nm or less, flowability becomes excellent and occurrence or fogging is further suppressed. In the case where an average primary particle size of the external additive is below 5 nm, flowability may degrade due to aggregation in the external additive. In the case where an average primary particle size of the external additive is above 200 nm, adhesion between the external additive and the toner particle is reduced so that the external additive falls off the toner particle to generate charge depression, with the result that fogging occurs. Accordingly, favorable images with no fogging or fixing failure can be more stably formed over a long period of time.

Further, the invention provides a developer comprising the toner mentioned above.

According to the invention, the developer includes the toner mentioned above. Accordingly, it is possible to bring chargeability and fixing property of the developer excellent over a long period of time, with the result that the developer capable of maintaining favorable developing property is obtained.

Further, it is preferable that the developer includes further a carrier, the developer constituting a two-component developer.

Further, according to the invention, the developer is the two-component developer composed of the toner mentioned above and a carrier. The toner according to the invention is excellent in flowability and fixing property, allowing the two-component developer having excellent chargeability and fixing property over a long period of time. Accordingly, favorable images with no fogging or fixing failure can be more stably formed over a long period of time.

Further, the invention provides a developing device for carrying out development by using the developer mentioned above.

Further, according to the invention, the electrostatic latent image is developed by using the developer according to the invention, so that the external additive can be prevented from attaching the carrier or the charging member and favorable toner images can be stably formed on a photoreceptor. Accordingly, it is possible to stably form favorable images with no fogging on a non-image part over a long period of time.

Further, the invention provides an image forming apparatus comprising:

an image bearing member onto which an electrostatic latent image is to be formed;

an electrostatic latent image forming section for forming the electrostatic latent image on the image bearing member; and the developing device mentioned above.

Further, according to the invention, the image forming apparatus is achieved including the image bearing member onto which the electrostatic latent image is to be formed, the electrostatic latent image forming section for forming the electrostatic latent image on the image bearing member, and the developing device according to the invention which device can form favorable toner images as described above. By forming images with the use of such an image forming apparatus, favorable images with no fogging or fixing failure can be stably formed over a long period of time.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
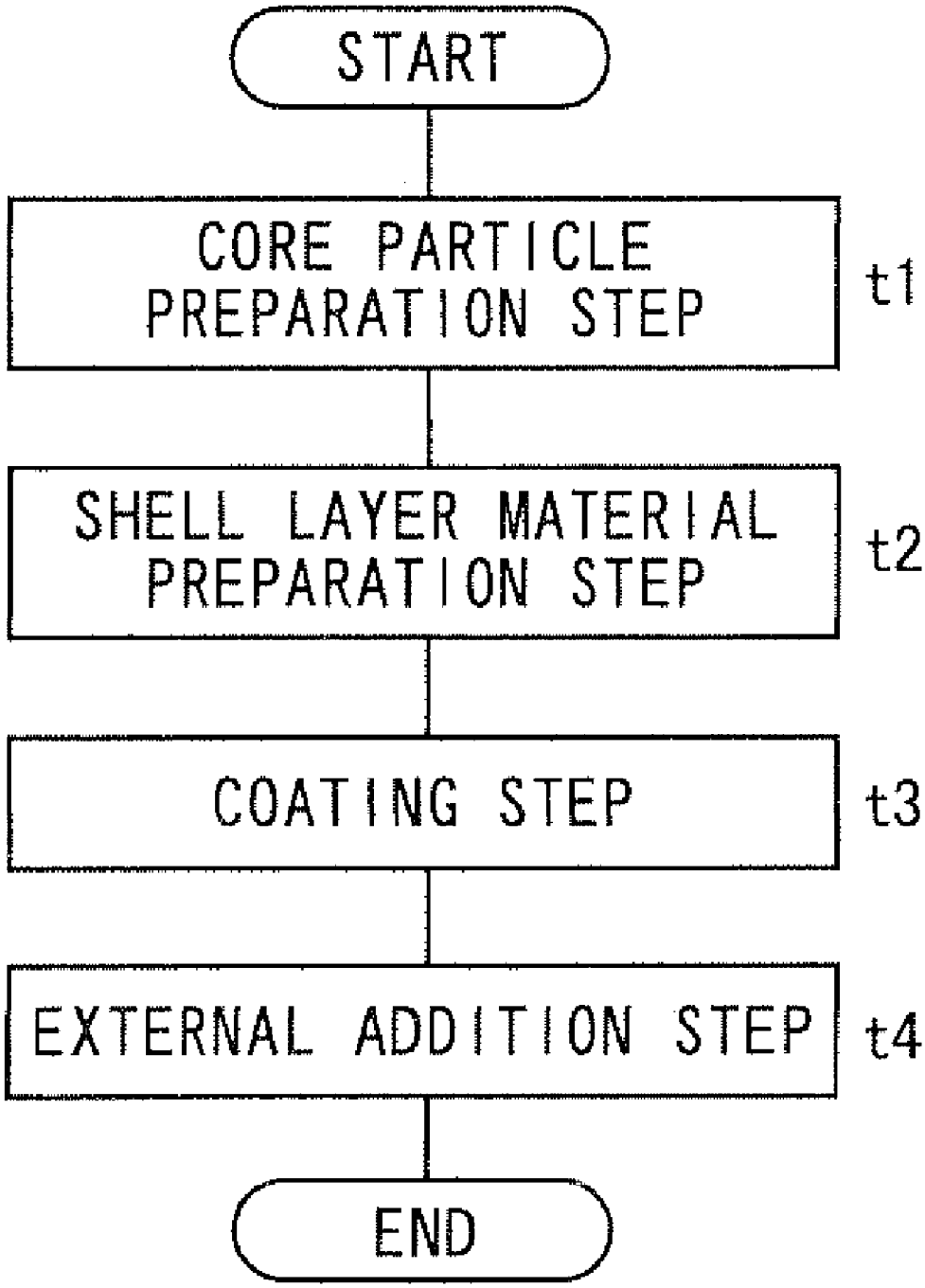
FIG. 1 is a flowchart showing a method of manufacturing toner according to a first embodiment of the invention.

Now referring to the drawings, preferred embodiments of the invention are described below.

1. Toner

The toner according to a first embodiment of the invention includes a toner particle including a core particle and a shell layer formed on a surface of the core particle, and an external additive, where (1) the shell layer is formed in a film on the surface of the core particle, (2) a shape factor SF-2 is 120 or more and 140 or less, and (3) a BET specific surface area measured by the BET method is 1.2 $m^2/cm^3$ or more and 4.0 $m^2/cm^3$ or less.

[1] Toner Particle

A toner particle contained in the toner of the embodiment comprises a core particle, and a shell layer formed on a surface of the core particle.

[1]-1.Core Particle

The core particle includes a binder resin, a colorant, a release agent, a charge control agent and the like.

(Binder Resin)

The binder resin is not particularly limited as long as it is customarily used as hinder resin for toner, and includes, for example, polyester, polyurethane, epoxy resin, acrylic resin, and styrene-acrylic resin, among which, acrylic resin, and styrene-acrylic resin are preferred. These resins may be used each alone, or two or more thereof may be used in combination. Further, a plurality of resins of the same kind but different in any one or plural elements of their molecular weight, monomer composition, etc. may be used in combination.

Polyester is preferable as binder resin for a color toner owing to its excellent transparency, as well as good powder flowability, low-temperature fixing property, and secondary color reproducibility etc. to be provided to core particles. For polyester, heretofore known substance may be used including polycondensation of polybasic acid and polyvalent alcohol, or the like.

For the polybasic acid, any substance known as monomer for polyester can be used including, for example: aromatic carboxylic acid such as terephthalic acid, isophthalic acid, phthalic anhydride, trimellitic anhydride, pyromellitic acid, and naphthalene dicarboxylic acid; aliphatic carboxylic acid such as maleic anhydride, fumaric acid, succinic acid, alkenyl succinic anhydride, and adipic acid; and methyl-esterified compounds of these polybasic acids. The polybasic acids may be used each alone, or two or more thereof may be used in combination.

For the polyvalent alcohol, any substance known as monomer for polyester can also be used including, for example: aliphatic polyvalent alcohol such as ethylene glycol, propylene glycol, butenediol, hexanediol, neopentyl glycol, and glycerin; alicyclic polyvalent alcohol such as cyclohexanediol, cyclohexanedimethanol, and hydrogenated bisphenol A; and aromatic diols such as ethylene oxide adduct of bisphenol A and propylene oxide adduct of bisphenol A. The polyvalent alcohols may be used each alone, or two or more thereof may be used in combination.

The polybasic acid and the polyvalent alcohol can undergo polycondensation reaction in an ordinary manner, that is, for example, the polybasic acid and the polyvalent alcohol are brought into contact with each other in the presence or absence of organic solvent and in the presence of polycondensation catalyst. The polycondensation reaction ends when an acid number, a softening temperature, etc. of the polyester to be produced reach predetermined values. The polyester is thus obtained. When the methyl-esterified compound of the polybasic acid is used as part of the polybasic acid, demethanol polycondensation reaction is caused. In the polycondensation reaction, a compounding ratio, a reaction rate, etc. of the polybasic acid and the polyvalent alcohol are appropriately modified, thereby being capable of, for example, adjusting a content of a carboxyl end group in the polyester and thus allowing for denaturation of the polyester. The denatured polyester can be obtained also by simply introducing a carboxyl group to a main chain of the polyester with use of trimellitic anhydride as polybasic acid. Note that polyester may also be used whose main chain and/or side chain is bonded to a hydrophilic radical such as a carboxyl group or a sulfonate group. Further, polyester may be grafted with acrylic resin.

In addition to the above polyester, crystalline polyester may be used. Crystalline polyester has generally a low electric resistance and a low melting temperature to be softened easily, so that when the crystalline polyester exposes on a surface of the toner, temporal stability such as preservation stability and chargeability degrades. Accordingly, crystalline polyester is not preferable to be used as main resin that composes a majority of the binder resin, but the crystalline polyester has an effect of lowering the melt viscosity of the toner when being used as additive. Therefore it is possible to intend to enhance fixing property of the toner. In such a case, a melting temperature of the crystalline polyester resin is preferably 60° C. or higher an 120° C., or lower, and a usage is not particularly limited but preferably 1. part by weight or more and 20 parts by weight or less with respect to 100 parts by weight of noncrystalline polyester resin.

For the crystalline polyester, heretofore known substance may be used including polycondensation of polybasic acid and polyvalent alcohol, or the like. Polybasic acid component includes, for example, aliphatic dicarboxylic acid such as oxalic acid, succinic acid, glutaric acid, adipic acid, suberic acid, azelaic acid and sebacic acid; aromatic dicarboxylic acid of dibasic acid such as phthalic acid, isophthalic acid and terephthalic acid; and anhydride and lower alkyl ester thereof. These may be used each alone, or two or more thereof may be used in combination.

The acrylic resin is not particularly limited, but acid group-containing acrylic resin can be preferably used. The acid group-containing acrylic resin can be produced, for example, by polymerization of acrylic resin monomer or polymerization of acrylic resin monomer and vinylic monomer with concurrent use of acidic group- or hydrophilic group-containing acrylic resin monomer and/or acidic group- or hydrophilic group-containing vinylic monomer.

For the acrylic resin monomer, heretofore known substance may be used including, for example, acrylic acid which may have a substituent, methacrylic acid which may have a substituent, acrylic acid ester which may have a substituent, and methacrylic acid ester which may have a substituent. Specific examples of the above acrylic resin monomer include: monomer of acrylic esters such as methyl acrylate, ethyl acrylate, isopropyl acrylate, n-butyl acrylate, isobutyl acrylate, n-amyl acrylate, isoamyl acrylate, n-hexyl acrylate, 2-ethylhexyl acrylate, n-octyl acrylate, decyl acrylate, and dodecyl acrylate; monomer of methacrylic esters such as methyl methacrylate, propyl methacrylate, n-butyl methacrylate, isobutyl methacrylate, n-amyl methacrylate, n-hexyl methacrylate, 2-ethylhexyl methacrylate, n-octyl methacrylate, decyl methacrylate, and dodecyl methacrylate; and hydroxyl group-containing monomer of (meth)acrylic esters such as hydroxyethyl acrylate and hydroxypropyl methacrylate. The acrylic resin monomers may be used each alone, or two or more thereof may be used in combination.

For the vinylic monomer, heretofore known substance may be used including, for example, styrene, α-methylstyrene, vinyl bromide, vinyl chloride, vinyl acetate, acrylonitrile, and methacrylonitrile. The vinylic monomers may be used each alone, or two or more thereof may be used in combination. The polymerization is effected by use of commonly-used radical initiator in accordance with a solution polymerization method, a suspension polymerization method, an emulsification polymerization method, or the like.

The styrene-acrylic resin includes, for example, styrene-acrylic acid methyl copolymer, styrene-acrylic acid ethyl copolymer, styrene-acrylic acid butyl copolymer, styrene-methacrylic acid methyl copolymer, styrene-methacrylic acid ethyl copolymer, styrene-methacrylic acid butyl copolymer, and styrenes acrylonitrile copolymer.

It is preferable that the binder resin has a glass transition temperature of 30° C. or higher and 80° C. or lower. The binder resin having a glass transition temperature lower than 30° C. easily causes blocking that the toner thermally aggregates inside the image forming apparatus, with the result that preservation stability may degrade. The binder resin having a glass transition temperature higher than 80° C. lowers fixing property of the toner onto a recording medium, which may cause fixing failure.

(Colorant)

As the colorant, it is possible to use organic dye, organic pigment, inorganic dye, inorganic pigment, or the like, which are customarily used in the relevant field.

Black colorant includes, for example, carbon black, chopper oxide, manganese dioxide, aniline black, activated carbon, non-magnetic ferrite, magnetic ferrite, and magnetite.

Yellow colorant includes, for example, yellow lead, zinc yellow, cadmium yellow, yellow iron oxide, mineral fast yellow, nickel titanium yellow, navel yellow, naphthol yellow S, hanza yellow G, hanza yellow 10G, benzidine yellow G, benzidine yellow GR, quinoline yellow lake, permanent yellow NCG, tartrazine lake, C.I. pigment yellow 12, C.I. pigment yellow 13, C.I. pigment yellow 14, C.I. pigment yellow 15, C.I. pigment yellow 17, C.I. pigment yellow 74, C.I. pigment yellow 93, C.I. pigment yellow 94, C.I. pigment yellow 138, C.I. pigment yellow 180, and C.I. pigment yellow 185.

Orange colorant includes, for example, red lead yellow, molybdenum orange, permanent orange GTR, pyrazolone orange, vulcan orange, indanthrene brilliant orange RK, benzidine orange G, indanthrene brilliant orange GK, C.I. pigment orange 31, and C.I. pigment orange 43.

Red colorant includes, for example, red iron oxide, cadmium red, red lead oxide, mercury sulfide, cadmium, permanent red 4R, lysol red, pyrazolone red, watching red calcium salt, lake red C, lake red D, brilliant carmine 6B, eosin lake, rhodamine lake B, alizarin lake, brilliant carmine 3B, C.I. pigment red 2, C.I. pigment red 3, C.I. pigment red 5, C.I. pigment red 6, C.I. pigment red 7, C.I. pigment red 15, C.I. pigment red 16, C.I. pigment red 48:1, C.I. pigment red 53:1, C.I. pigment red 57:1, C.I. pigment red 122, C.I. pigment red 123, C.I. pigment red 139, C.I. pigment red 144, C.I. pigment red 149, C.I. pigment red 166, C.I. pigment red 177, C.I. pigment red 178, and C.I. pigment red 222.

Purple colorant includes, for example, manganese purple, fast violet B, and methyl violet lake.

Blue colorant includes, for example, Prussian blue, cobalt blue, alkali blue lake, Victoria blue lake, phthalocyanine blue, non-metal phthalocyanine blue, phthalocyanine blue-partial chlorination product, fast sky blue, indanthrene blue BC, C.I. pigment blue 15, C.I. pigment blue 15:2, C.I. pigment blue 15:3, C.I. pigment blue 16, and C.I. pigment blue 60.

Green colorant includes, for example, chromium green, chromium oxide, pigment green B, malachite green lake, final yellow green G, and C.I. pigment green 7.

White colorant includes, for example, those compounds such as zinc white, titanium oxide, antimony white, and zinc sulfide.

The colorants may be used each alone, or two or more thereof with different colors may be used in combination. Further, two or more thereof with the same color may be used in combination. A usage of colorant is not limited to a particular amount, but preferably 0.1 part by weight to 20 parts by weight and more preferably 0.2 part by weight to 10 parts by weight with respect to 100 parts by weight of the binder resin.

(Release Agent)

As the release agent, it is possible to use any substance which is customarily used in the relevant field, including, for example, petroleum wax such as paraffin wax and derivative thereof, and microcrystalline wax and derivative thereof; hydrocarbon-based synthetic wax such as Fischer-Tropsch wax and derivative thereof, polyolefin wax (polyethylene wax and polypropylene wax, etc.) and derivative thereof, low-molecular-weight polypropylene wax and derivative thereof, and polyolefinic polymer wax (low-molecular-weight polyethylene wax, etc.) and derivative thereof; vegetable wax such as carnauba wax and derivative thereof, rice wax and derivative thereof, candelilla wax and derivative thereof, and haze wax; animal wax such as bees wax and spermaceti wax; fat and oil-based synthetic wax such as fatty acid amide and phenolic fatty acid ester; long-chain carboxylic acid and derivative thereof; long-chain alcohol and derivative thereof; silicone polymer; and higher fatty acid. Note that examples of the derivative include oxide, block copolymer of vinylic monomer and wax, and graft-modified derivative of vinylic monomer and wax. A usage of wax may be appropriately selected from a wide range without particular limitation, but preferably 0.2 part by weight to 20 parts by weight, more preferably 0.5 part by weight to 10 parts by weight, and particularly preferably 1.0 part by weight to 8.0 parts by weight with respect to 100 parts by weight of the binder resin.

(Charge Control Agent)

The usable charge control agent includes positive charge control agent and negative charge control agent which are customarily used in the relevant field. The positive charge control agent includes, for example, basic dye, quaternary ammonium salt, quaternary phosphonium salt, aminopyrine, pyrimidine compound, polynuclear polyamino compound, aminosilane, nigrosine dye and derivative thereof, triphenylmethane derivative, guanidine salt, and amidine salt. The negative charge control agent includes oil-soluble dye such as oil black and spilon black, metal-containing azo compound, azo complex dye, metal naphthenate, metal complex or metal salt (the metal includes chrome, zinc, zirconium or the like) of salicylic acid and derivative thereof, a fatty acid soap, long-chain alkylcarboxylic acid salt, and a resin acid soap. The above charge control agents may be used each alone or according to need, two or more thereof may be used in combination. A usage of charge control agent is not limited to a particular level and may be selected as appropriate from a wide range.

The charge control agent may be contained in the core particle or the shell layer made up of fine resin particles at a coating step described below, or both in the core particle and shell layer. In the case where the charge control agent is contained in the core particle, it is preferable that 0.5 part by weight to 3 parts by weight of the charge control agent is contained with respect to 100 parts by weight of the core particles.

In the case where the charge control agent is contained in the shell layer, it is preferable that 0.5 part by weight to 3 parts by weight of the charge control agent is contained with respect to 100 parts by weight of a material of the shell layer.

In the case where the charge control agent is contained both in the core particle and shell layer, the charge control agent is preferably contained such that a total of a content of the charge control agent with respect to 100 parts by weight of the core particles and a content thereof with respect to 100 parts by weight of the material of the shell layer is 0.5 part by weight to 3 parts by weight.

[1]-2. Shell Layer

The shall layer is formed in a film on the surface of the core particle. By forming the shall layer in a film on the surface of the core particle, even when stress is applied due to agitation in a developing container for example, the toner particles can be prevented from being aggregated. Thereby, the toner can be prevented from changing in properties in the long-term use.

Also, by forming the shall layer in a film on the surface of the core particle, low melting temperature component such as the release agent is not exposed on the surface of the core particle, and component of the surface of the toner particle is so uniform that the external additive is uniformly attached to the surface of the toner particle so as to restrain the external additive from falling off the toner particle, thereby being capable of enhancing chargeability. Further, there exists no component whose polarity is the same as that of the external additive on the surface of the toner particle, so that the external additive is restrained from falling off the toner particle. Moreover, the surface composition of the toner particle is so uniform that the external additive easily attaches uniformly, with the result that since there exists no component whose polarity is the same as that of the external additive on the surface of the toner particle, the external additive is restrained from failing off.

The shell layer comprises resin, and the resin usable for the shell layer is not particularly limited, including, for example, polyester resin, acrylic resin, styrene-acrylic copolymer resin, and styrene resin.

It is preferable that the toner particle on which the shell layer is formed has approximately a shape factor SF-1 of 130 or more and 150 or less, and a shape factor SF-2 of 120 or more and 140 or less.

As described above, the toner according to the embodiment has a BET specific surface area of 1.2 $m^2/cm^3$ or more and 4.0 $m^2/cm^3$ or less, which is measured by the BET method. Conventionally, a toner is provided in which external additive is attached to a surface of a core particle on which a shell layer is not formed, and a value of the specific surface area is 3.2 $m^2/cm^3$ or more and 6.8 $m^2/cm^3$ or less, while surface composition of the toner particle in such toner is nonuniform and there exists component whose polarity is the same as that of the external additive, so that the external additive easily falls off the core particle when a BET specific surface area is 3.2 $m^2/cm^3$ or more. However, when the shell layer is formed on the surface of the core particle, the external additive is restrained from falling off as described above. Accordingly, the toner according to the embodiment suppress fall-off of the external additive even when a BET specific surface area of the toner is within a range of 3.2 $m^2/cm^3$ or more and 4.0 $m^2/cm^3$ or less.

(Cover Area)

It is preferable that the shell layer is formed on the surface of the core particle within a range of 80% or more and 100% or less of surface area of the core particle. The shell layer formed within the above range allows exposure of the surface of the core particle to be substantially reduced and surface composition of the toner particle to be further uniformed. Accordingly, the external additive is further uniformly attached to the surface of the toner particle, thereby further advancing chargeability, with the result that favorable images with no fogging or fixing failure can be more stably formed over a long period of time. When the surface area of the core particle covered with the shell layer is below 80% of the overall surface area of the core particle, the exposed area of the surface of the core particle is increased so that the low melting temperature component such as the wax and pigment contained in the core particle is softened, with the result that long-term charge stability may degrade. The surface area of the core particle can be calculated by measuring a volume average particle size of the core particles on the assumption that the core particle is a sphere. Also, area of the core particle covered with the shell layer can be calculated by using an image analyzer, etc., based on an image photographed by an electron microscope. In the case where the shell layer is formed on a large portion (80% or more) of the surface of the core particle, the same effect can be obtained as in the case where the shell layer is formed on the entire surface of the core particle.

(Thickness of Shell Layer)

The thickness of the shell layer is preferably formed such that a portion whose thickness is 0.05 82 m or more and 0.5 μm or less accounts for at least 80% of the surface area, and an average value of thick portions of the shell layer is more than twice an average value of thin portions of the shell layer. When a difference of film thickness is provided to the shell layer, the shell layer is easily deformed by heat and pressure during fixing so that core particle component is easily melted-out on a sheet, thereby being capable of maintaining fixing property of the core particle. When an average value of the thick portions of the shell layer is not more than twice an average value of the thin portions of the shell layer, the shell layer is not so easily deformed during fixing that a lot of energy is required to fix the core particle component on a sheet, with the result that it is difficult to ensure a fixable area.

The average value of the thick portions of the shell layer and the average value of the thin portions thereof are obtained as follows. For example, a cross-section image of the toner particle is photographed by a transmission electron microscope, image analysis is performed by image processing or the like, and some thickness of the shell layer is measured at a number of portions. In the order from thickest portion, the predetermined numbers of measured values are selected and an average value of the selected measured values is defined as the average value of the thick portions. In the same way, in the order from thinnest portion, the predetermined numbers of measured values are selected and an average value of the selected measured values is defined as the average value of the thin portions. Note that the thick portion and the thin portion of the film thickness may be the portions that deviate from the above thickness range of 0.05 μm or more and 0.5 μm or less. The predetermined numbers are two or more. An average value of the measured values is defined gas the average value of the thickness of the shell layer.

[1]-3. Toner Particles

It is preferable that a volume average particle size of the toner particles is 3 μm or more and 10 μm or less. By bringing a volume average particle size of the toner particles into such a range, the toner with excellent flowability and less fogging can be obtained. In the case where a volume average particle size of the toner particles is below 3 μm, flowability may degrade. In the case where a volume average particle size of the toner particles is above 10 μm, image quality may degrade. Note that the volume average particle size of the toner particles is measured in the same way as the volume average particle size of the core particles described above.

[2] External Additive

The toner according to the embodiment is obtained by mixing the above toner particles and external additive. For the external additive contained in the toner according to the embodiment, heretofore known substance may be used including, for example, silica and titanium oxide. These may be used each alone, or two or more thereof may be used in combination.

It is preferable that the external additive is surface-treated and hydrophobically treated with silicone resin, silane coupling agent or the like in order to enhance environmental and temporal stability. A hydrophobical treatment may be appropriately performed without particular limitation, for example, according to a heretofore known surface-modifying method of a fine silica powder. In this method, silazane compound is brought into contact with alkoxysilane at 0° C. to 400° C. in the vapor phase, liquid phase and solid phase in the presence of water, and subsequently heated at 50° C. to 400° C. so as to eliminate excess of silazane compound.

In view of flowability and a charge amount required to the toner, effect of addition on photoreceptor wear, environmental property of the toner, or the like, it is preferable that an average primary particle size of the external additive is 5 nm or more and 200 nm or less. When an average primary particle size of the external additive is 5 nm or more and 200 nm or less, flowability becomes excellent and occurrence of fogging is further suppressed. In the case where an average primary particle size of the external additive is below 5 nm, flowability may degrade due to aggregation in the external additive. In the case where an average primary particle size of the external additive is above 200 nm, adhesion between the external additive and the toner particle is reduced so that the external additive falls off the toner particle to generate charge depression, with the result that fogging occurs. Accordingly, favorable images with no fogging or fixing failure can be more stably formed over a long period of time.

The average primary particle size of the external additive can be measured by a particle size distribution measurement device using dynamic light scattering such as DLS-800 (trade name, manufactured by Otsuka Electronics Co., Ltd.) and COULTER N4 (trade name, manufactured by Coulter Electronics Ltd.), but is preferably directly obtained by performing image analysis of a photographed image obtained from a scanning electron microscope (SEM) or transmission electron microscope (TEM) since it is difficult to dissociate second aggregation of the articles after the hydrophobical treatment.

[3] Toner

The shape factor SF-2 of the toner according to the embodiment including the above toner particles and the external additive is 120 or more and 140 or less. When the shape factor SF-2 is within the above range, it is possible to bring flowability excellent and charge rising favorable. Further, cleaning property is also advanced. When the shape factor SF-2 of the toner is below 120, cleaning property may degrade since the shape of the toner is too spherical. When the shape factor SF-2 is above 140, flowability may degrade since the surface of the toner includes an undesirable large number of concavities and convexities, and thus adhesion of the toner is enhanced.

The shape factor SF-2 of the toner is a value measured by the following process.

Toner dispersion liquid was prepared by adding 2.0 g of the toner, 1 ml of sodium, alkyl ether sulfate and 50 ml of purified water into an 100 ml beaker and stirring them well. The toner dispersion liquid was further dispersed by an ultrasonic homogenizer (manufactured by Nippon Seiki Co., Ltd.) at an output of 50 μA for 5 minutes. After supernatant solution was removed from the liquid that had been left for 6 hours, 50 ml of purified water was added and stirring was carried out for 5 minutes by a magnetic stirrer, and subsequently suction filtration was performed by using a membrane filter (1 μm pore diameter). Washed substance remained on the membrane filter was vacuum-dried in a desiccator containing silica gel over night.

On surfaces of the toner washed in this way, a metal film (an Au film whose thickness was 0.5 μm) was formed by sputter deposition. Among the metal film-covered toner, 200 to 300 particles were randomly picked up to be photographed by a scanning electron microscope (trade name: S570, manufactured by Hitachi, Ltd.) at 5 kV accelerating voltage and at 1,000-fold magnification. This electron microscope-photographed data was image analyzed by an image analysis software (trade name: A-ZO-KUN, manufactured by Asahi Kasei Engineering Corporation). Toner analysis parameters of the image analyzing software "A-ZO-KUN" are set as follows, small figure remove area: 100 pixels, shrinkage and separation: 1 time; small figure: 1; frequency: 10; noise elimination filter: none, shading: none, a unit of result displayed: μm. Based on maximum length MXLNG, peripheral length PERI and figure area AREA of the particles in the toner obtained therefrom, the shape factor SF-2 was derived from the following formula (A).

$$SF\text{-}2=\{(PERI)^2/AREA\}\times(100/4\pi) \quad (A)$$

The shape factor SF-2 is a value represented by the above formula (A), which indicates a degree of concavity and convexity of the surface shape of the toner. There are no concavity and convexity on the toner surface when a value of SF-2 is 100, and the higher the value of SF-2 is, the more pronounced the concavity and convexity are.

A specific surface area of the toner according to the embodiment, measured by the BET method, is 1.2 $m^2/cm^3$ or more and 4.0 $m^2/cm^3$ or less. When a BET specific surface area is within the above range, a fall-off amount of the external additive can be suppressed, with the result that soiling of a carrier and a charging member due to the failing-off external additive can be reduced. Accordingly, charge depression of a developer in forming images is disappeared and occurrence of fogging can be suppressed. Further, fixing inhibition due to the external additive can be suppressed. When a BET specific surface area is below 1.2 $m^2/cm^3$, the external additive has not been added onto the surface of the toner particle, so that flowability may degrade. When a BET specific surface area is above 4.0 $m^2/cm^3$, a large amount of external additive has been added onto the surface of the toner particle. Accordingly, the external additive easily fails off the surface of the toner particle, so that the carrier and the charging member are soiled by the fallen-off external additive, with the result that charge amount may lower, and fogging may occur. Meanwhile, fixing may be inhibited by the external additive.

The BET specific surface area is measured by the BET three-points method, in which a gradient A is obtained from an adsorbed amount of nitrogen with respect to three points of relative pressure, and a value of the specific surface area is obtained from the BET formula.

As described above, the shell layer is formed in a film on the surface of the core particle, the shape factor SF-2 of the toner is 120 or more and 140 or less, and BET specific surface area is 1.2 $m^2/cm^3$ or more and 4.0 $m^2/cm^3$ or less. When the shell layer is formed on the surface of the core particle, the shape factor SF-2 of the toner is 120 or more and 140 or less, and a BET specific surface area is 1.2 $m^2/cm^3$ or more and 4.0 $m^2/cm^3$ or less, the toner with excellent chargeability, fixing property and flowability over a long period of time can be achieved. By using such toner to form images, favorable images with no fogging or fixing failure can be stably formed over a long period of time.

It is preferable that a BET specific surface area is 1.2 $m^2/cm^3$ or more and 3.2 $n^2/cm^3$ or less. When a BET specific surface area of the toner is 1.2 $m^2/cm^3$ or more and 3.2 $m^2/cm^3$ or less, it is possible that charge stability is maintained, fixing inhibition due to the external additive is further suppressed, and non-offset region is broadened. Accordingly, favorable images with no fogging or fixing failure can be more stably formed over a long period of time.

2. Method of Manufacturing Toner

In the following, description will be given for a method of manufacturing a toner according to a first embodiment of the invention. Toner particles contained in the toner according to the invention are manufactured, for example, by attaching and melt-bonding fine resin particles to core particles using adhesion aiding agent for increasing adhesion between the core particle and the fine resin particle. FIG. 1 is a flowchart showing a method of manufacturing the toner according to a first embodiment of the invention. The method of manufacturing the toner according to a first embodiment includes a core particle preparation step t1, a shell layer material preparation step t2, a coating step t3, and an external addition step t4. The core particle preparation step t1 and the shell layer material preparation step t2 may be carried out in reverse order in terms of time or may be carried out in parallel.

[1] Core Particle Preparation Step

At the core particle preparation step t1, a core particle containing a binder resin and a colorant is prepared. The core particle used for the toner according to the invention contains the binder resin and the colorant and may further contain a release agent, a charge control agent, or the like.

The core particles can be manufactured in accordance with a commonly-used method of manufacturing a toner, including, for example, dry processes such as a pulverization method; and wet processes such as a suspension polymerization method, an emulsification aggregation method a dispersion polymerization method, dissolution suspension method, and a melting emulsification method. However, when using amorphous-shaped core particles obtained from a kneading and pulverizing method, the core particle is coated with a shell later having favorable property, so that functionalization of a toner surface is possible, which functionalization was conventionally impossible, with the result that an outstanding effect is achieved in that smoothness, durability or the like is enhanced.

The amorphous-shaped core particles described herein mean particles which have no uniform shape but different shape one another, and whose surfaces have irregular surfaces due to concavity and convexity. For the amorphous-shaped core particles, particles can be used, approximately within the range where the shape factor SF-1 that represents a shape of the particle is 140 or more and 160 or less, and the shape factor SF-2 is 130 or more and 150 or less. When the shape factor SF-1 of the core particle is 140 or more and 160 or less, and the shape factor SF-2 is 130 or more and 150 or less, the toner with excellent cleaning property and flowability can be obtained. When the shape factor SF-1 of the core particle is below 140, the shape of the core particle is too spherical and thus the shape of the toner also tends to be spherical, which toner has been prepared such that the shell layer is formed on the surface of the core particle. Accordingly, cleaning property may degrade. When the shape factor SF-1 of the core particle is above 160, transferability of the toner may degrade, which toner has been prepared such that the shell layer is formed on the surface of the core particle. When the shape factor SF-2 of the core particle is below 130, the number of concavities and convexities on the surface of the core particle is so low undesirably that cleaning property of the toner may degrade, which toner has been prepared such that the shell layer is formed on the surface of the core particle. When the shape factor SF-2 of the core particle is above 150, flowability of the toner may degrade, which toner has been prepared such that the shell layer is formed on the surface of the core particle. Accordingly, favorable images with no fogging or fixing failure can be more stably formed over a long period of time.

By forming the shell layer on the surface of the core particle, the shape factor is changed, and the toner particle coated with the shell layer having the shape factor SF-1 approximately within the range of 130 or more and 150 or less, and the shape factor SF-2 approximately within the range of 120 or more and 140 or less can be obtained.

There will be hereinbelow described a method of preparing the core particles which employs the pulverization method.

In the pulverization method, toner composition containing the binder resin, the colorant, and the other toner additive component described above is dry-mixed by a mixer and thereafter melt-kneaded by a kneader. A kneaded material obtained through the melt-kneading process is cooled and solidified into a solidified material which is then pulverized by a pulverizer. A resultant material is subsequently treated with particle size adjustment such as classification according to need. The core particles are thus obtained.

Usable mixers include heretofore known mixers including, for example, Henschel-type mixing apparatuses such as HENSCHELMIXER (trade name, manufactured by Mitsui Mining Co., Ltd.), SUPERMIXER (trade name, manufactured by Kawata MFG Co., Ltd.), and MECHANOMILL (trade name, manufactured by Okada Seiko Co., Ltd.), ANGMILL (trade name, manufactured by Hosokawa Micron Corporation), HYBRIDIZATION SYSTEM (trade name, manufactured by Nara Machinery Co., Ltd.), and COSWOSYSTEW (trade name, manufactured by Kawasaki Heavy Industries, Ltd.).

Usable kneaders include heretofore known kneaders including, for example, commonly-used kneaders such as a twin-screw extruder, a three roll mill, and an laboplast mill. Specific examples of such kneaders, for example, include single or twin screw extruders such as TEM-100B (trade name, manufactured by Toshiba Machine Co., Ltd.), PCM-65/87 and PCM30 (both of which are trade names and manufactured by Ikegai, Ltd.), and open roll-type kneading machines such as KNEADEX (trade name, manufactured by Mitsui Mining Co., Ltd.).

Additive for synthetic resin, such as colorant, may be formed into a master batch so as to be dispersed uniformly into the kneaded material. Moreover, two or more of additives for synthetic resin may be formed into a particulate composite. The particulate composite can be manufactured, for example, in a manner that an appropriate amount of water, lower alcohol, and the like is added to two or more of additives for synthetic resin which are then granulated through a commonly-used granulator such as a high-speed mill, followed by being dried. The master batch and the particulate composite are mixed with a powder mixture during a dry-mixing operation.

An volume average particle size of the core particles obtained by the above pulverization method is preferably 3 μm or more and 10 μm or less, and more preferably 5 μm or more and 8 μm or less. When a volume average particle size of the core particles is 3 μm or more and 10 μm or less, high-resolution images can be formed stably over a long period of time. When a volume average particle size of the core particles as below 3 μm, the particle size of the core particle is too small, which may cause the toner to be excessively charged and have low flowability. The excessively-charged toner having the low flowability cannot be stably supplied to the photoreceptor, thus causing background fog, decrease in image density, and the like. When a volume average particle size of the core particles exceeds 10 μm, the particle size of the core particle is so large that high-resolution images cannot be obtained. Further, the larger the particle size of the core particle is, the narrower the specific surface area thereof is, resulting in the smaller charge amount of the toner. When the toner is less charged, the toner cannot be stably supplied to the photoreceptor, and thus may spatter inside the apparatus to cause internal soiling.

The volume average particle size of the core particles is measured by a particle size distribution-measuring apparatus "Multisizer III" (manufactured by Beckman Coulter, Inc.). The measurement condition is described below.

Aperture diameter: 100 μm

The number of particles for measurement: 50,000 counts

Analyzing software: Coulter Multisizer AccuComp version 1.19 (manufactured by Beckman Coulter, Inc.)

Electrolyte: ISOTON II (prepared by Beckman Coulter, Inc.)

Dispersant: Sodium alkyl ether sulfate

A measurement method is described below.

Fifty ml of the electrolyte, 20 mg of the core particles and 1 ml of the dispersant are added into a beaker, which are subjected to a dispersion treatment in an ultrasonic dispersion apparatus for three minutes, thereby preparing a measurement sample. The particle sizes of the core particles are measured by the apparatus "Multisizer III", and based on the measurement results obtained, a volume particle size distribution of the core particles is thus obtained, from which the volume average particle size of the core particles is then determined. The volume average particle size means particle size $D_{50V}$ where the accumulated volume from the larger particle size side in the volume particle size distribution corresponds to 50%.

[2] Shell Layer Material Preparation Step

At shell layer material preparation step t2, fine resin particles containing at least resin are prepared, and adhesion aiding agent for increasing adhesion between the core particle and the fine resin particle is prepared.

A resin usable for the fine resin particles is not particularly limited and thus includes, for example, polyester resin, acrylic resin, styrene-acryl copolymer resin, and styrene resin.

It is preferable that the fine resin particle contains styrene-acryl copolymer resin among those cited above. By attaching the fine resin particle containing styrene-acryl copolymer resin to the surface of the core particle so as to form the shell layer in a film, controllability of the film thickness is more enhanced. Further, by using styrene-acryl copolymer resin as a main component, whole surface covering and film thickness controlling become possible. Moreover, by subjecting to a dying treatment, it is possible to observe the shell layer by a transmission electron microscope so as to easily measure the thickness of the shell layer.

In addition to this, styrene-acryl copolymer resin has a lot of advantages to compose the shell layer as the resin material, since the styrene-acryl copolymer resin is easy to adjust a glass transition temperature or softening temperature, as well as easy to adjust the particle size depending on a synthetic method, and the styrene-acryl copolymer resin is lightweight, strong, high in transparency, and inexpensive, etc.

A resin contained in the fine resin particle may be of the same sort as that of the binder resin contained in the core particle. The different sort of resin from the binder resin contained in the core particle is also applicable for the fine resin particle, and from the perspective of treating the toner with surface modification, the use of the different sort of resin is preferable. In case of using such different sort of resin for the fine resin particle, it is preferable to select resin whose softening temperature is higher than that of the binder resin contained in the core particle. By so doing, the toner are prevented from being melt-bonded while stored, allowing for enhancement in storage stability.

A softening temperature of the resin contained in the fine resin particle is preferably 80° C. or higher and 140° C. or lower although its preferable range is varied depending on an image forming apparatus where the toner is used.

Further, a glass transition temperature of the resin contained in the fine resin particle is preferably within a range of 50° C. or higher and 80° C. or lower, and more preferably within a range of 60° C. or higher and 80° C. or lower.

By using the resin within such range, the fine resin particle is easily formed in a film and film thickness is easily adjusted (a difference of thickness is caused due to softening. The resin having a glass transition temperature above 80° C. degrades fixing property since a film can be formed but is difficult to be made thin in its thickness. The resin having a glass transition temperature below 50° C. can also be formed in a film but causes trouble such as aggregation in the toner relating to preservation stability and durability of the toner.

The fine resin particles as described above can be obtained by polymerizing monomer, for example.

An average particle size of the fine resin particles before coating needs to be sufficiently smaller than an average particle size of the core particles. Further, an average particle size of the fine resin particles before coating is preferably 0.2 μm or less. When an average particle size of the fine resin particles before coating is 0.2 μm or less, in the core particle having an amorphous shape, the fine resin particles are easily buried in a concave portion on the surface of the core particle so that the shell layer easily covers the entire surface of the core particle. When an average particle size of the fine resin particles before coating is above 0.2 μm, the concave portion of the core particle may not be covered, or the number of fine particles required to cover the entire surface is increased. Further, the shell layer is not so easily deformed that a lot of energy is required to fix the core particle component on a sheet surface, with the result that it is difficult to ensure a fixable area.

At the shell layer material preparation step t2, adhesion aiding agent for increasing adhesion between the core particle and the fine resin particle at the coating step t3 described below is also prepared. The adhesion aiding agent indicates liquid which can enhance wettability of the fine resin particle to the core particle. The adhesion aiding agent is preferably liquid in which the core particle is not dissolved. Since the adhesion aiding agent needs to be removed after coating of a resin film, volatile liquid is preferable.

The adhesion aiding agent preferably include, for example, water or lower alcohol. Plural elements thereof may be used by mixture. Examples of the lower alcohol are methanol, ethanol, and propanol.

<Coating Step>

At the coating step t3, the fine resin particle is attached to the core particle and melt-bonded to the surface of the core particle with use of the adhesion aiding agent for increasing adhesion between the core particle and the fine resin particle. By so doing, the cone particle is coated with the resin film and thus the shell layer is formed on the surface of the core particle. The coating of the resin film is performed by using, for example, a surface-modifying apparatus. The surface-modifying apparatus includes: a treatment chamber for agitating the core particles and the fine resin particles; a flow passage through which the core particles and the fine resin particles are flowed; and an atomizer for atomizing the adhesion aiding agent either in the flow passage or the treatment chamber. In the embodiment, the surface-modifying apparatus is provided with an agitator for agitating the core particles and the fine resin particles inside the treatment chamber.

An apparatus of closed type may be used as the treatment chamber for agitating the core particles and the fine resin particles. The atomizer has an adhesion aiding agent reservoir for housing the adhesion aiding agent; a carrier gas reservoir for housing carrier gas; and a liquid-atomizing unit for spraying a mixture obtained by mixing the adhesion aiding agent and the carrier gas to the particles contained inside the apparatus thereby atomizing droplets of the adhesion aiding agent to the particles.

The carrier gas may be compressed air or the like.

The liquid-atomizing unit may be a marketed product, including such in apparatus that a two-fluid nozzle: HM-6 (trade name, manufactured by Fuso Seiki Co., Ltd.) is connected to a tube pump: MP-1000A (trade name, manufactured by Tokyo Rikakikai Co., Ltd. ) through which a metered amount of adhesion aiding agent can be supplied. The agitator may be an agitator rotor which can provide the core particles with mechanical and thermal energy based on impact force, or the like.

The apparatus provided with the agitator may be a marketed product, including, for example, Henschel-type mixing apparatuses such as HENSCHELMIXER (trade name, manufactured by Mitsui. Mining Co., Ltd.), SUPERMIXER (trade name, manufactured by Kawata MFG Co., Ltd.), and MECHANOMILL (trade name, manufactured by Okada Seiko Co., Ltd.), ANGMILL (trade name, manufactured by Hosokawa Micron Corporation), HYBRIDIZATION SYSTEM (trade name, manufactured by Nara Machinery Co., Ltd.), and COSMOSYSTEM (trade name, manufactured by Kawasaki Heavy Industries, Ltd.) The liquid-atomizing unit is installed in such an apparatus including the above-cited mixer, which can be then used as the surface-modifying apparatus according to the present embodiment.

The coating of the resin film on the core particle by using the surface-modifying apparatus is performed as follows. At the outset, the core particles and the fine resin particles are put in the apparatus and agitated therein by the agitator while the adhesion aiding agent is atomized into the apparatus. To the core particles and the fine resin particles, the atomized adhesion aiding agent is given and the thermal energy is added by agitation so that the surfaces of the core particles and the fine resin particles are swollen and softened. In addition, mechanical impact force generated by the agitator is also applied to the core particles and the fine resin particles so that the fine resin particle is firmly adhered to the surface of the core particle and simultaneously, the fine resin particle is partially flattened and melt-bonded to at least either the core particle or the adjacent fine resin particle.

In order to prevent aggregation of the core particles, it is preferable that a temperature inside the surface-modifying apparatus is controlled (heated and/or cooled) according to need.

It is preferable that a temperature inside the apparatus is controlled to be not lower than a temperature lower by 20° C. than a glass transition temperature Tg of the core particle, and lower than the glass transition temperature Tg of the core particle. By agitating and coating the core particles and the fine resin particles while controlling heating a temperature not lower than a temperature lower by 20° C. than the glass transition temperature Tg of the core particle and lower than the glass transition temperature Tg of the core particle, the shell layer can be formed in a film covering over almost the entire surface of the core particle. When the temperature inside the surface-modifying apparatus is a glass transition temperature Tg of the core particle or higher, the core particles may be excessively molten to aggregate inside the apparatus in manufacturing the toner. Further, when a temperature inside the surface-modifying apparatus is lower than a temperature lower by 20° C. than the glass transition temperature Tg, the surface of the core particle is not sufficiently swollen and softened to form the shell layer over almost the entire surface of the core particle.

The adhesion aiding agent may be liquid effective in plasticating the fine resin particle and the core particle without dissolving them, including, for example, alcohol such as methanol and ethanol. It is preferable that the adhesion aiding agent is atomized in the state where the core particles and the fine resin particles, or the core particles attaching the fine resin particles are suspended inside the apparatus. When the adhesion aiding agent is atomized in the state where the particles are suspended inside the apparatus, the adhesion aiding agent is uniformly attached to the surfaces of the particles, and the fine resin particles are plasticated with a synergic effect of heating and impact force, with the result that the resin film is formed on the surface of the core particle. This enables to prevent aggregation in the toner so as not to generate a coarse particle in manufacturing the toner, thus allowing for the toner made of the particles uniform in size. The core particles can be suspended inside the apparatus, for example, by agitation of the agitator or the air supply.

A use ratio of the fine resin particles is not limited to a particular level, but needs to be such a ratio as to coat the entire surfaces of the core particles. The fine resin particles are used preferably at a ratio of 1 part by weight or more and 30 parts by weight or less with respect to 100 parts by weight of the core particles. When a ratio of the fine resin particles is below 1 part by weight, the entire surfaces of the core particles may not be coated with the shell layers. When a ratio of the fine resin particles is above 30 parts by weight, the thickness of the shell layer may be too large, possibly leading to deterioration of the fixing property of the toner, depending on a material constituting the fine resin particle.

A usage of adhesion aiding agent is not limited to a particular amounts but preferable is such an amount as to have the entire surfaces of the core particles wet. A usage of adhesion aiding agent is determined based on a usage of core particles. Further, a usage of adhesion aiding agent can be adjusted due to a length of time, a frequency, etc. of the atomization effected by the atomizer.

The core particles may be coated with the resin film by a surface-modifying apparatus which includes: a device for housing the core particles; and an atomizer for atomizing the mixture of the fine resin particles and the adhesion aiding agent into the device. The surface-modifying apparatus as just stated may be the same as the apparatus mentioned above except the mixture of the adhesion aiding agent and the fine resin particles is not stored in the adhesion aiding agent reservoir.

[4] External Addition Step

At the external addition step t4, the toner particles obtained through the steps t1 to t3 and the external additive are mixed so as to externally add the external additive to the toner particles. The mixing of the toner particles and the external additive may be performed by any methods, which uses, for example, a V blender, a Henschel mixer, a ribbon blender, and a mixing and grinding machine.

A usage of external additive is preferably 0.2 part by weight to 4.0 parts by weight with respect to 100 parts by weight of the toner particles, and more preferably 0.5 part by weight to 3.5 parts by weight. When a usage is below 0.2 part by weight, flowability degrades, and when a usage is above 4.0 parts by weight, a fail-off amount of the external additive increases so as to cause charge depression, and fixing is prevented by the external additive so as to narrow a fixing area.

(Other Methods of Manufacturing Toner)

As described above, the toner particles contained in the toner according to a first embodiment are obtained, in which the shell layer is formed in a firm on the surface of the core particle, but the toner may also be manufactured in such a way that the shell layer contains materials other than a fine resin particle, including, for example, charge control agent and external additive. When the shell layer contains the charge control agent, charge rising property, environmental stability and life stability are enhanced. Further, when the shell layer contains the external additive, the external additive is fixed into the shell layer so as to prevent the external additive from falling off the toner particle, thereby being capable of maintaining the surface resistance and flowability of the toner over a long period of time.

In the state where the shell layer contains the charge control agent or the external additive, for example, the shell layer is formed on the surface of the core particle by using the fine resin particles that have been prepared to contain the charge control agent or the external additive, thereby the shell layer may contain the charge control agent or the external additive, or the charge control agent, external additive, fine resin particles and core particles are agitated in the surface-modifying apparatus, thereby the shell layer may be formed to contain the charge control agent and the external additive on the surface of the core particle.

Also in the state where the toner particle is manufactured such that the external additive is contained in the shell layer, the external additive may be contained as described in Step t4 of adding.

The usable charge control agent contained in the shell layer includes positive charge control agent and negative charge control agent which are customarily used in the relevant field, as in the case of the core particle.

The positive charge control agent includes, for example, basic dye, quaternary ammonium salt, quaternary phosphonium salt, aminopyrine, pyrimidine compound, polynuclear polyamino compound, aminosilane, nigrosine dye, derivative thereof, triphenylmethane derivative, guanidine salt, and amidine salt.

The negative charge control agent includes oil-soluble dye such as oil black and spilon black, metal-containing azo compound, azo complex dye, metal naphthenate, metal complex or metal salt (the metal includes chrome, zinc, zirconium, aluminum or the like) of salicylic acid and of derivative thereof, a fatty acid soap, long-chain alkylcarboxylic acid salt, a resin acid soap, bisdiphenylglycolic acid, metal complex or metal salt (the metal is boron) of bisdiphenylglycolic acid derivative, other commercially-available charge control resin (abbreviated as CCR), or the like. The charge control agents may be used each alone, or according to need, two or more thereof may be used in combination. A usage of charge control agent is not limited to a particular level and may be selected as appropriate from a wide range.

Among the above, at least one or more of salicylic acid compound, bisdiphenylglycolic acid compound, and charge control resin is preferably selected in particular. These kinds of the charge control agent have high transparency and are therefore capable of forming clearer images.

A content of the charge control agent is preferably 1 part by weight or more and 10 parts by weight or less with respect to 100 parts by weight of the fine resin particles.

It is preferable that a dispersion diameter of the charge control agent to be contained in the shell layer is 1μm or loss. As a result, the charge control agent becomes less likely to aggregate and thereby being capable of uniformly dispersing in the shell layers on the surfaces of the core particles. Further, the change control agent is prevented from falling off the core particle, thereby more enhancing charge rising property, environmental stability, and life stability. When a dispersion diameter of the charge control agent is above 1 μm, the charge control agent easily falls off the core particle.

The charge control agent soluble in the adhesion aiding agent may be used, and such charge control agent can be dispersed more uniformly in the surface of the toner.

For the external additive added to the shell layer, as in the case of the above external additive for the toner, customarily used substance in the relevant field may be used including, for example, silica and titanium oxide. These may be used each alone, or two or more thereof may be used in combination.

In view of flowability and a charge amount required to the toner, effect of addition on photoreceptor wear, environmental property of the toner, or the like, it is preferable that an average primary particle size of external additive is 5 nm to 200 nm. In the case where an average primary particle size of the external additive is below 5 nm, aggregation in the external additive occurs so that flowability degrades. Further, in the case where an average primary particle size of the external additive is above 200 nm, the external additive falls off to cause charge depression, with the result that fogging increases on a non-image part.

The average primary particle size of the external additive can be measured in the same way as the external additive for the toner described below.

A usage of external additive is preferably 0.2 part by weight to 5.0 parts by weight with respect to 100 parts by weight of the toner, and more preferably 0.5 part by weight to 4.0 parts by weight. When a usage is below 0.2 part by weight, an existential amount is too low to ensure adequate flowability and adjust the surface resistance of the toner. Further, when a usage is above 5.0 parts by weight, the external additive easily falls off the shell layer so that the surface resistance of the toner and long-term stability of flowability may be impaired.

3. Developer

The toner according to a first embodiment of the invention can be used. In form of either an one-component developer or two-component developer. The developer according to a second embodiment of the invention includes the toner according to a first embodiment of the invention. Accordingly, it is possible to bring chargeability and fixing property of the developer excellent over a long period of time, with the result that the developer capable of maintaining favorable developing property is obtained.

In the case where the toner according to a first embodiment is used in form of an one-component developer, only the toner is used without using a carrier. Further, in the case where the toner is used in form of the one-component developer, a blade and a fur brush are used to effect fictional electrification at a developing sleeve so that the toner are attached onto the sleeve, thereby conveying the toner to perform image formation.

In the case where the toner according to a first embodiment is used in form of a two-component developer, the toner according to the invention is used together with a carrier. The toner according to the invention is excellent in flowability and fixing property, allowing the two-component developer having excellent chargeability and fixing property over a long period of time. Accordingly, favorable images with no fogging or fixing failure can be more stably formed owner a lowly period of time.

(Carrier)

As the carrier, heretofore known substance can be used including, for example, single or complex ferrite composed of iron, copper, zinc, nickel, cobalt, manganese, chromium or the like; a resin-coated carrier having a carrier core particle whose surface is coated with coating substance; or a resin-dispersion carrier in which magnetic particles are dispersed in resin. As the coating substance, heretofore known substance can be used including, for example, polytetrafluoroethylene, monochloro-trifluoroethylene polymer, polyvinylidene-fluoride, silicone resin, polyester resin, metal compound of di-tertiary-butyl salicylic acid, styrene resin, acrylic resin, polyamide, polyvinyl butyral, nigrosine, aminoacrylate resin, basic dye or like thereof, a fine silica powder, and a fine alumina powder. In addition, the resin used for the resin-dispersion carrier is not limited to particular resin, and examples thereof include styrene-acrylic resin, polyester resin, fluorine resin, and phenol resin. Both of the coating substance in the resin-coated carrier and the resin used for the resin-dispersion carrier are preferably selected according to the toner components. The substances and resins listed above may be used each alone, and two or more thereof may be used in combination.

A particle in the carrier preferably has a spherical shape or flattened shape. A particle size of the carrier is not limited to a particular size, but in consideration of forming higher-quality images, the particle size of the carrier is preferably 10 μm to 100 μm and more preferably 20 μm to 50 μm. Further, a resistivity of the carrier is preferably $10^8$ Ω·cm or more, and more preferably $10^{12}$ Ω·cm or more. The resistivity of the carrier is obtained as follows. At the outset, the carrier is put in a container having a cross section of 0.50 $cm^2$, thereafter being tapped. Subsequently, a load of 1 $kg/cm^2$ is applied by use of a weight to the carrier particles which are held in the container. When an electric field of 1,000 V/cm is generated between the weight and a bottom electrode of the container by application of voltage, a current value is read. The current value indicates the resistivity of the carrier. When a resistivity is low, electric charges will be injected into the carrier upon application of bias voltage to a developing sleeve, thus causing the carrier particles to be more easily attached to the photoreceptor. In this case, breakdown of bias voltage is more liable to occur.

Magnetization intensity (maximum magnetization) of the carrier is preferably 10 emu/g to 60 emu/g and more preferably 15 emu/g to 40 emu/g. The magnetization intensity depends on magnetic flux density of a developing roller. Under the condition of ordinary magnetic flux density of the developing roller, however, no magnetic binding force work on the carrier having magnetization intensity less than 10 emu/g, which may cause the carrier to spatter. The carrier having magnetization intensity larger than 60 emu/g has too large bushes to keep the none contact state with an image bearing member in the non-contact development. Further, the carrier having magnetization intensity larger than 60 emu/g may cause sweeping streaks to appear on a toner image in the contact development.

A use ratio of the toner to the carrier in the two-component developer is not limited to a particular ratio, and the use ratio is appropriately selected according to kinds of the toner and carrier. To take the resin-coated carrier (having density of 5 $g/cm^2$) as an example, a usage of toner may be determined such that a content of the toner in the developer is 2% by weight to 30% by weight and preferably 2% by weight to 20% by weight of a total amount of the developer. Further, in the two-component developer, coverage of the carrier with the toner is preferably 40% to 80%.

Figure 2:
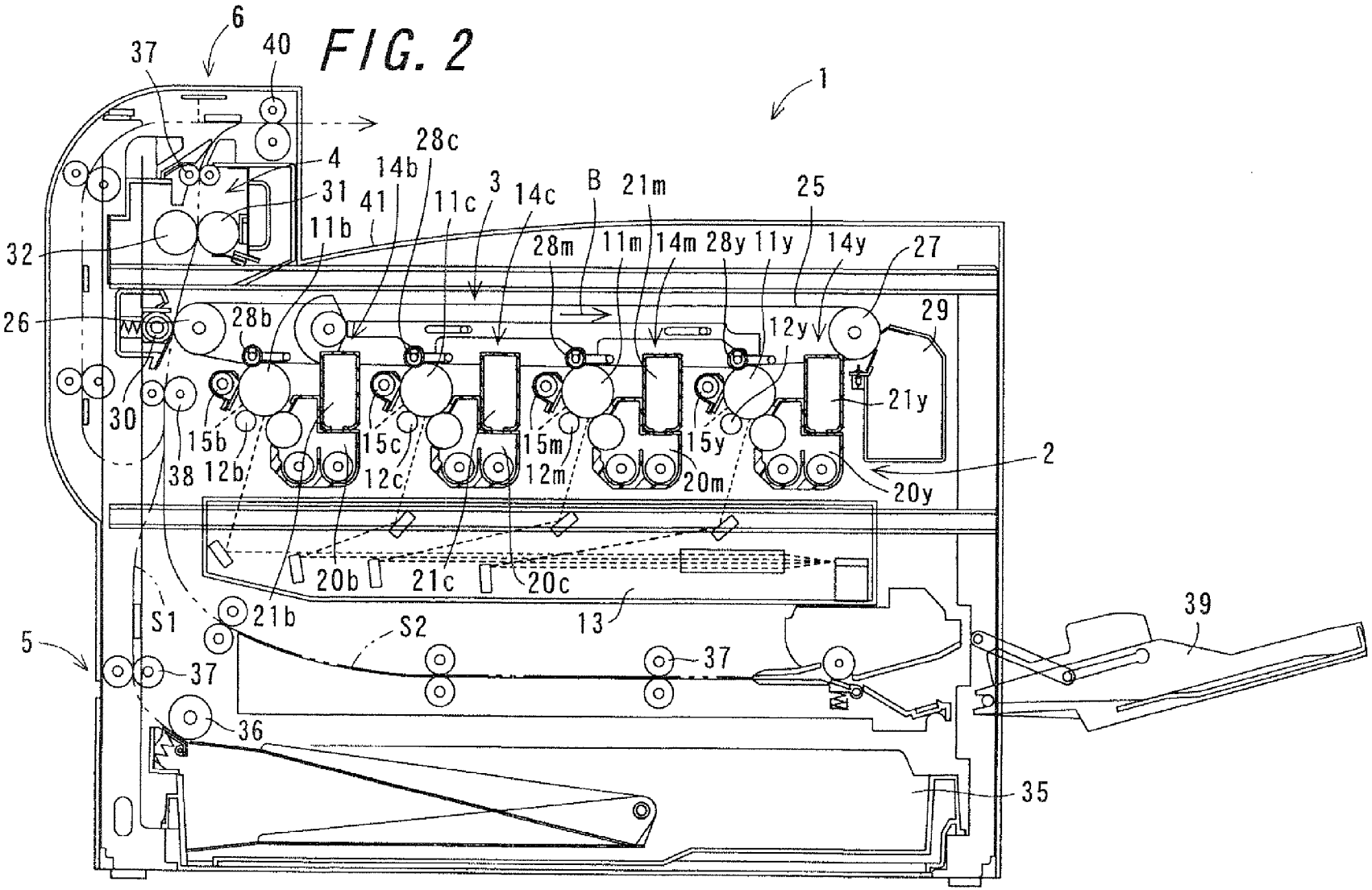
FIG. 2 is a schematic sectional view schematically showing a configuration of an image forming apparatus according to a third embodiment of the invention.

FIG. 2 is a schematic sectional vew schematically showing a configuration of an image forming apparatus 1 according to a third embodiment of the invention. The image forming apparatus 1 is a multifunctional peripheral which combines a copier function, a printer function, and a facsimile function. In the image forming apparatus 1, according to image information transmitted thereto, a full-color or black-and-white image is formed on a recording medium. To be specific, three print modes, i.e., a copier mode, a printer mode, and a facsimile mode are available in the image forming apparatus 1, one of which print modes is selected by a control unit (not shown) in response to an operation input given by an operating section (not shown), a reception of a print job given by a personal computer, a mobile computer, an information record storage medium or an external equipment having a memory device, or the like.

The image forming apparatus 1 includes a toner image forming section 2, an transfer section 3, a fixing section 4, a recording medium feeding section 5, and a discharging section 6. In accordance with image information of respective colors of black (b), cyan (c), magenta (m), and yellow (y) which are contained in color image information, there are provided respectively four sets of the components constituting the toner image forming section and some parts of the components contained in the transfer section 3. The four sets of respective components provided for the respective colors are distinguished herein by giving alphabets indicating the respective colors to the end of the reference numerals, and in the case where the sets are collectively referred to, only the reference numeral is shown.

The toner image forming section 2 includes a photoreceptor drum 11 that serves as an image bearing member, a charging section 12, an exposure unit 13, a developing device 14, and a cleaning unit 15. The charging section 12, the developing device 14, and the cleaning unit 15 are disposed in the order just stated around the photoreceptor drum 11. The charging section 12 is disposed vertically below the developing device 14 and the cleaning unit 15. The charging section 12 and the exposure unit 13 serve as an electrostatic latent image forming section for forming an electrostatic latent image on the photoreceptor drum 11.

The photoreceptor drum 11 is rotatably supported around an axis thereof by a drive section (not shown), and includes a conductive substrate and a photosensitive layer formed on a surface of the conductive substrate (not shown). The conductive substrate may be formed into various shapes such as a cylindrical shape, a circular columnar shape, and a thin film sheet shape. Among these shapes, a cylindrical shape is preferred.

The conductive substrate is formed of a conductive material. As the conductive material, those customarily used in the relevant field can be used including, for example, metals such as aluminum, copper, brass, zinc, nickel, stainless steel, chromium, molybdenum, vanadium, indium, titanium, gold, and platinum; alloys formed of two or more of the metals; a conductive film in which a conductive layer containing one or two or more of aluminum, aluminum alloy, tin oxide, gold, indium oxide, etc. is formed on a film-like substrate such as a synthetic resin film, a metal film, and paper; and resin composition containing conductive particles and/or conductive polymer. As the film-like substrate used for the conductive film, a synthetic resin film is preferred and a polyester film is particularly preferred. Further, as a method of forming the conductive layer in the conductive film, vapor deposition, coating, etc. are preferred.

The photosensitive layer is formed, for example, by stacking a charge generating layer containing charge generating substance, and a charge transporting layer containing charge transporting substance. In this case, an undercoat layer 5 preferably formed between the conductive substrate and the charge generating layer or the charge transporting layer. When the undercoat layer is provided, flaws and irregularities present on the surface of the conductive substrate are covered, leading to advantages such that the photosensitive layer has a smooth surface, chargeability of the photosensitive layer can be prevented from degrading during repetitive use, and the chargeability of the photosensitive layer can be enhanced under at least either a low temperature circumstance or a low humidity circumstance. Further, a laminated photoreceptor is also applicable which has a highly-durable three-layer structure having a photoreceptor surface-protecting layer provided on the top layer.

The charge generating layer contains, as main substance, charge generating substance that generates charges under irradiation of light, and optionally contains known binder resin, plasticizer, sensitizer, etc. according to need. As the charge generating substance, substance used customarily in the relevant field can be used including, for example, perylene pigment such as perylene imide and perylenic acid anhydride; polycyclic quinone pigment such as quinacridone and anthraquinone; phthalocyanine pigment such as metal and non-metal phthalocyanine, and halogenated non-metal phthalocyanine; squalium dye; azulenium dye; thiapylirium dye; and azo pigment having carbazole skeleton, styrylstilbene skeleton, triphenylamine skeleton, dibenzothiophene skeleton, oxadiazole skeleton, fluorenone skeleton, bisstilbene skeleton, distyryloxadiazole skeleton, or distyryl carbazole skeleton. Among these, non-metal phthalocyanine pigment, oxotitanyl phthalocyanine pigment, bisazo pigment containing a fluorene ring and/or a fluorenone ring, bisazo pigment containing an aromatic amine, trisazo pigment and the like have high charge generating ability and are suitable for forming a highly-sensitive photosensitive layer. The charge generating substances may be used each alone, or two or more thereof may be used in combination. A content of the charge generating substance is not particularly limited, but preferably from 5 parts by weight to 500 parts by weight and more preferably from 10 parts by weight to 200 parts by weight with respect to 100 parts by weight of the binder resin in the charge generating layer. Also as the binder resin for the charge generating layer, substance used customarily in the relevant field can be used including, for example, nelamine resin, epoxy resin, silicone resin, polyurethane, acrylic resin, vinyl chloride-vinyl acetate copolymer resin, polycarbonate, phenoxy resin, polyvinyl butyral, polyallyate, polyamide, and polyester. The binder resins may be used each alone or optionally two or more thereof may be used in combination according to need.

The charge generating layer can be formed by dissolving or dispersing an appropriate amount of charge generating substance, binder resin and, optionally, plasticizer, sensitizer, etc. respectively in appropriate organic solvent which is capable of dissolving or dispersing these components described above, to prepare coating solution for the charge generating layer, and then applying the coating solution for the charge generating layer to the surface of the conductive substrate, followed by drying. The film thickness of the charge generating layer obtained in this way is not particularly limited, but preferably from 0.05 μm to 5 μm and more preferably from 0.1 μm to 2.5 μm.

The charge transporting layer stacked over the charge generating layer contains, as essential substance, charge transporting substance having an ability of receiving and transporting charges generated from the charge generating substance, and binder resin for the charge transporting layer, and optionally contains known antioxidant, plasticizer, sensitizer, lubricants etc.

As the charge transporting substance, substance used customarily in the relevant field can be used including, for example: electron donating substance such as poly-N-vinyl carbazole, derivative thereof, poly-γ-carbazolyl ethyl glutamate, derivative thereof, pyrene-formaldehyde condensation product, derivative thereof, polyvinylpyrene, polyvinyl phenanthrene, oxazole derivative, oxadiazole derivative, imidazole derivative, 9-(p-diethylaminostyryl)anthracene, 1,1-bis(4-dibenzylaminophenyl)propane, styrylanthracene, styrylpyrazoline, pyrazoline derivative, phenyl hydrazone, hydrazone derivative, triphenylamine compound, tetraphenyldiamine compound, triphenylmethane compound, stilbene compound, and azine compound having 3-methyl-2-benzothiazoline ring; and electron accepting substance such as fluorenone derivative, dibenzothiophene derivative, indenothiophene derivative, phenanthrenequinone derivative, indenopyridine derivative, thioquisantone derivative, benzo[c]cinnoline derivative, phenazine oxide derivative, tetracyanoethylene, tetracyanoquinodimethane, bromanil, chloranil, and benzoquinone. The charge transporting substances may be used each alone, or two or more thereof may be used in combination. A content of the charge transporting substance is not particularly limited, but preferably from 10 parts by weight to 300 parts by weight and more preferably from 30 parts by weight to 100 parts by weight with respect to 200 parts by weight of the binder resin in the charge transporting substance.

As the binder resin for the charge transporting layer, it is possible to use substance which is used customarily in the relevant field and capable of uniformly dispersing the charge transporting substance, including, for examples polycarbonate, polyallylate, polyvinylbutyral, polyamide, polyester, polyketone, epoxy resin, polyurethane, polyvinylketone, polystyrene, polyacrylamide, phenolic resin, phenoxy resin, polysulfone resin, and copolymer resin thereof. Among the above, in view of film forming property, and wear resistance, electrical property etc. of the obtained charge transporting layer, it is preferable to use polycarbonate which contains bisphenol Z as monomer component (hereinafter referred to as "bisphenol z polycarbonate"), mixture of bisphenol Z polycarbonate and other polycarbonate, and the like. The binder resins may be used each alone, or two or more thereof may be used in combination.

The charge transporting layer preferably contains antioxidant together with the charge transporting substance and the binder resin for the charge transporting layer. Also for the antioxidant, substance used customarily in the relevant field can be used including, for example, Vitamin E, hydroquinone, hindered amine, hindered phenol, paraphenylene diamine, arylalkane and derivative thereof, organic sulfur compound, organic phosphorus compound, and the like.

The antioxidants may be used each alone, or two or more thereof may be used in combination. A content of the antioxidant is not particularly limited, but is 0.01% by weight to 10% by weight and preferably 0.05% by weight to 5% by weight of a total amount of substance constituting the charge transporting layer. The charge transporting layer can be formed by dissolving or dispersing an appropriate amount of charge transporting substance, binder resin and, optionally, antioxidant, plasticizer, sensitizer, etc. respectively in appropriate organic solvent which is capable of dissolving or dispersing the substance described above, to prepare coating solution for the charge transporting layer, and applying the coating solution for the charge transporting layer to the surface of the charge generating layer followed by drying. The film thickness of the charge transporting layer obtained in this way is not particularly limited, but preferably 10 μm to 50 μm and more preferably 15 μm to 40 μm. Note that it is also possible to form a photosensitive layer in which charge generating substance and charge transporting substance are present in one layer. In this case, a kind and content of the charge generating substance and the charge transporting substance, a kind of the binder resin, and other additive may be the same as those in the case of forming separately the charge generating layer and the charge transporting layer.

In the embodiment, as described above, there is used a photoreceptor drum which has an organic photosensitive layer containing the charge generating substance and the charge transporting substance. It is, however, also possible to use, instead of the above photoreceptor drum, a photoreceptor drum which has an inorganic photosensitive layer containing silicon or the like.

The charging section 12 faces the photoreceptor drum 11 and is disposed away from the surface of the photoreceptor drum 11 longitudinally along the photoreceptor drum 11. The charging section 12 charges the surface of the photoreceptor drum 11 so that the surface of the photoreceptor drum 11 has a predetermined polarity and potential. As the charging section 12, it is possible to use a charging brush type charging device, a charger type charging device, a pin array type charging device, an ion-generating device, etc. Although the charging section 12 is disposed away from the surface of the photoreceptor drum 11 in the embodiment, the configuration is not limited thereto. For example, a charging roller may be used as the charging section 12, and the charging roller may be disposed in pressure-contact with the photoreceptor drum. It is also possible to use a contact-charging type charger such as a charging brush or a magnetic brush.

The exposure unit 13 is disposed such that a light beam corresponding to each color information emitted from the exposure unit 13 passes between the charging section 12 and the developing device 14 and reaches the surface of the photoreceptor drum 11. In the exposure unit 13, the image information is converted into light beams corresponding to each color information of black (b), cyan (c), magenta (m), and yellow (y), and the surface of the photoreceptor drum 11 which has been evenly charged by the charging section 12, is exposed to the light beams corresponding to each color information to form electrostatic latent images on the surfaces of the photoreceptor drums 11. As the exposure unit 13, for example, it is possible to use a laser scanning unit having a laser-emitting section and a plurality of reflecting mirrors. The other usable examples of the exposure unit 13 may include an LED array, and a unit in which a liquid-crystal shutter and a light source are appropriately combined with each other.

The cleaning unit 1 removes the toner which remains on the surface of the photoreceptor drum 11 after the toner image has been transferred to the recording medium in order to clean the surface of the photoreceptor drum 11. In the cleaning unit 15, for example, a platy member is used such as a cleaning blade. In the image forming apparatus according to the invention, an organic photoreceptor drum is mainly used as the photoreceptor drum 11. A surface of the organic photoreceptor drum contains resin component as main component and therefore tends to be degraded by chemical action of ozone which is generated by corona discharging of a charging device. The degraded surface part is, however, worn away by abrasion through the cleaning unit 15 and thus removed reliably, though gradually. Accordingly, the problem of the surface degradation caused by the ozone, etc. is virtually solved, and it is thus possible to stably maintain the potential of charge given by the charging operation over a long period of time. Although the cleaning unit 15 is provided in the embodiment, no limitation is imposed on the configuration and the cleaning unit 15 does not have to be provided.

In the toner image forming section 2, signal light corresponding to the image information is emitted from the exposure unit 13 to the surface of the photoreceptor drum 11 which has been evenly charged by the charging section 12, thereby forming an electrostatic latent image; the toner is then supplied from the developing device 14 to the electrostatic latent image, thereby forming a toner image; the toner image is transferred to an intermediate transfer belt 25; and subsequently the toner which remains on the surface of the photoreceptor drum 11 is removed by the cleaning unit 15. A series of toner image forming operations just described is repeatedly carried out.

The transfer section 3 is disposed above the photoreceptor drum 11 includes the intermediate transfer belt 25, a driving roller 26, a driven roller 27, an intermediate transferring roller 28*b*, 28*c*, 28*m*, 28*y*, a transfer belt cleaning unit 29, and a transferring roller 30. The intermediate transfer belt 25 is an endless belt stretched between the driving roller 26 and the driven roller 27, thereby forming a loop-shaped travel path. The intermediate transfer belt 25 rotates in an arrow B direction. When the intermediate transfer belt 25 passes by the photoreceptor drum 11 in contact therewith, the transfer bias voltage whose polarity is opposite to the polarity of the charged toner on the surface of the photoreceptor drum 11 is applied from the intermediate transferring roller 28 which is disposed opposite to the photoreceptor drum 11 across the intermediate transfer belt 25, with the result that the toner image formed on the surface of the photoreceptor drum 11 is transferred onto the intermediate transfer belt 25. In case of a full-color image, the toner images of respective colors formed on the respective photoreceptor drums 11 are sequentially transferred and overlaid onto the intermediate transfer belt 25, thus forming a full-color toner image. The driving roller 26 can rotate around an axis thereof with the aid of a drive section (not shown), and the rotation of the driving roller 26 drives the intermediate transfer belt 25 to rotate in the arrow B direction. The driven roller 27 can be driven to rotate by the rotation of the driving roller 26, and imparts constant tension to the intermediate transfer belt 25 so that the intermediate transfer belt 25 does not go slack.

The intermediate transferring roller 28 is disposed in pressure-contact with the photoreceptor drum 11 across the intermediate transfer belt 25, and capable of rotating around its own axis by a drive section (not shown). The intermediate transferring roller 28 is connected to a power source (not shown) for applying the transfer bias voltage as described above, and has a function of transferring the toner image formed on the surface of the photoreceptor drum 11 to the intermediate transfer belt 25. The transfer belt cleaning unit 29 is disposed opposite to the driven roller 27 across the intermediate transfer belt 25 so as to come into contract with an outer circumferential surface of the intermediate transfer belt 25. When the intermediate transfer belt 25 contacts the photoreceptor drum 11, the toner is attached to the intermediate transfer belt 25 and may cause soiling on a reverse side of the recording medium, and therefore the transfer belt cleaning unit 29 removes and collects the toner on the surface of the intermediate transfer belt 25. The transferring roller 30 is disposed in pressure-contact with the driving roller 26 across the intermediate transfer belt 25, and capable of rotating around its own axis by a drive section (not shown). In a pressure-contact portion (a transfer nip portion) between the transferring roller 30 and the driving roller 26, the toner image which has been carried by the intermediate transfer belt 25 and thereby conveyed to the pressure-contact portion is transferred onto a recording medium fed from the later-described recording medium feeding section 5. The recording medium carrying the toner image is fed to the fixing section 4. In the transfer section 3, the toner image is transferred from the photoreceptor drum 11 onto the intermediate transfer belt 25 in a pressure-contact portion between the photoreceptor drum 11 and the intermediate transferring roller 28, and by the intermediate transfer belt 25 rotating in the arrow B direction, the transferred toner image is conveyed to the transfer nip portion where the toner image is transferred onto the recording medium.

The fixing section 4 is provided downstream of the transfer section 3 along a conveyance direction of the recording medium, and contains a fixing roller 31 and a pressure roller 32. The fixing roller 31 can rotate by a drive section (not shown), and heats the toner constituting the unfixed toner image carried on the recording medium so that the toner is molten to be fixed on the recording medium. Inside the fixing roller 31 is provided a heating section (not shown). The heating section heats the fixing roller 31 so that a surface of the fixing roller 31 has a predetermined temperature (heating temperature). For the heating section, a heater, a halogen lamp, and the like can be used, for example. The heating section is controlled by a fixing condition control section. In the vicinity of the surface of the fixing roller 31 is provided a temperature detecting sensor which detects a surface temperature of the fixing roller 31. A result detected by the temperature detecting sensor is written to a memory section of the later-described control unit. The pressure roller 32 is disposed in pressure-contact with the fixing roller 31, and supported so as to be rotatably driven by the rotation of the fixing roller 31. The pressure roller 32 helps the toner image to be fixed onto the recording medium by pressing the toner and the recording medium when the toner is molten to be fixed on the recording medium by the fixing roller 31. A pressure-contact portion between the fixing roller 31 and the pressure roller 32 is a fixing nip portion. In the fixing section 4, the recording medium onto which the toner image has been transferred in the transfer section 3 is nipped by the fixing roller 31 and the pressure roller 32 so that when the recording medium passes through the fixing nip portion, the toner image is pressed and thereby fixed onto the recording medium under heat, whereby an image is formed.

The recording medium feeding section 5 includes an automatic paper feed tray 35, a pickup roller 36, conveying rollers 37, registration rollers 38, and a manual paper feed tray 39. The automatic paper feed tray 35 is disposed in a vertically lower part of the image forming apparatus and in form of a container-shaped member for storing the recording media. Examples of the recording medium include plain paper, color copy paper, sheets for overhead projector, and postcards. The pickup roller 36 takes out sheet by sheet the recording media stored in the automatic paper feed tray 35, and feeds the recording media to a paper conveyance path S1. The conveying rollers 37 are a pair of roller members disposed in pressure-contact with each other, and convey the recording medium to the registration rollers 38. The registration rollers 38 are a pair of roller members disposed in pressure-contact with each other, and feed to the transfer nip portion the recording medium fed from the conveying rollers 37 in synchronization with the conveyance of the toner image carried on the intermediate transfer belt 25 to the transfer nip portion. The manual paper feed tray 39 is a device for storing recording mediums which are different from the recording mediums stored in the automatic paper feed tray 35 and may have any size and which are to be taken into the image forming apparatus 1. The recording medium taken in from the manual paper feed tray 39 passes through a paper conveyance path S2 by use of the conveying rollers 37, thereby being fed to the registration rollers 38. In the recording medium feeding section 5, the recording medium supplied sheet by sheet from the automatic paper feed tray 35 or the manual paper feed tray 39 is fed to the transfer nip portion on synchronization with the conveyance of the toner image carried on the intermediate transfer belt 25 to the transfer nip portion.

The discharging section 6 includes the conveying rollers 37, discharging rollers 40, and a catch tray 41. The conveying rollers 37 are disposed downstream of the fixing nip portion along the paper conveyance direction, and convey toward the discharging rollers 40 the recording medium onto which the image has been fixed by the fixing section 4. The discharging rollers 40 discharge the recording medium onto which the image has been fixed, to the catch tray 41 disposed on a vertically upper surface of the image forming apparatus. The catch tray 41 stores the recording medium onto which the image has been fixed.

The image forming apparatus 1 includes a control unit (not shown). The control unit is disposed, for example, in an upper part of an internal space of the image forming apparatus 1, and contains a memory section, a computing section, and a control section. To the memory section of the control unit are inputted, for example, various set values obtained by way of an operation panel (not shown) disposed on the upper surface of the image forming apparatus, results detected from a sensor (not shown) etc. disposed in various portions inside the image forming apparatus, and image information obtained from an external equipment. Further, programs for operating various functional elements are written. Examples of the various functional elements include, for example, a recording medium determining section, an attachment amount control section, and a fixing condition control section. For the memory section, those customarily used in the relevant filed can be used including, for example, a read only memory (PROM), a random access memory (RAM), and a hard disk drive (HDD). For the external equipment, it is possible to use electrical and electronic devices which can form or obtain the image information and which can be electrically connected to the image forming apparatus. Examples of the external equipment include, for example, a computer, a digital camera, a television, a video recorder, a DVD (digital versatile disc) recorder, an HDDVD (high-definition digital versatile disc), a Blu-ray disc recorder, a facsimile machine, and a mobile computer. The computing section takes out various data (such as an image formation order, the detected result, and the image information) written in the memory section and the programs for various functional elements, and then makes various determinations. The control section sends to a relevant device a control signal in accordance with the result determined by the computing section, thus performing control on operations. The control section and the computing section include a processing circuit which is achieved by a microcomputer, a microprocessor, etc. having a central processing unit (CPU) The control unit contains a main power source as well as the above-stated processing circuit. The power source supplies electricity to not only the control unit but also respective devices provided inside the image forming apparatus.

Figure 3:
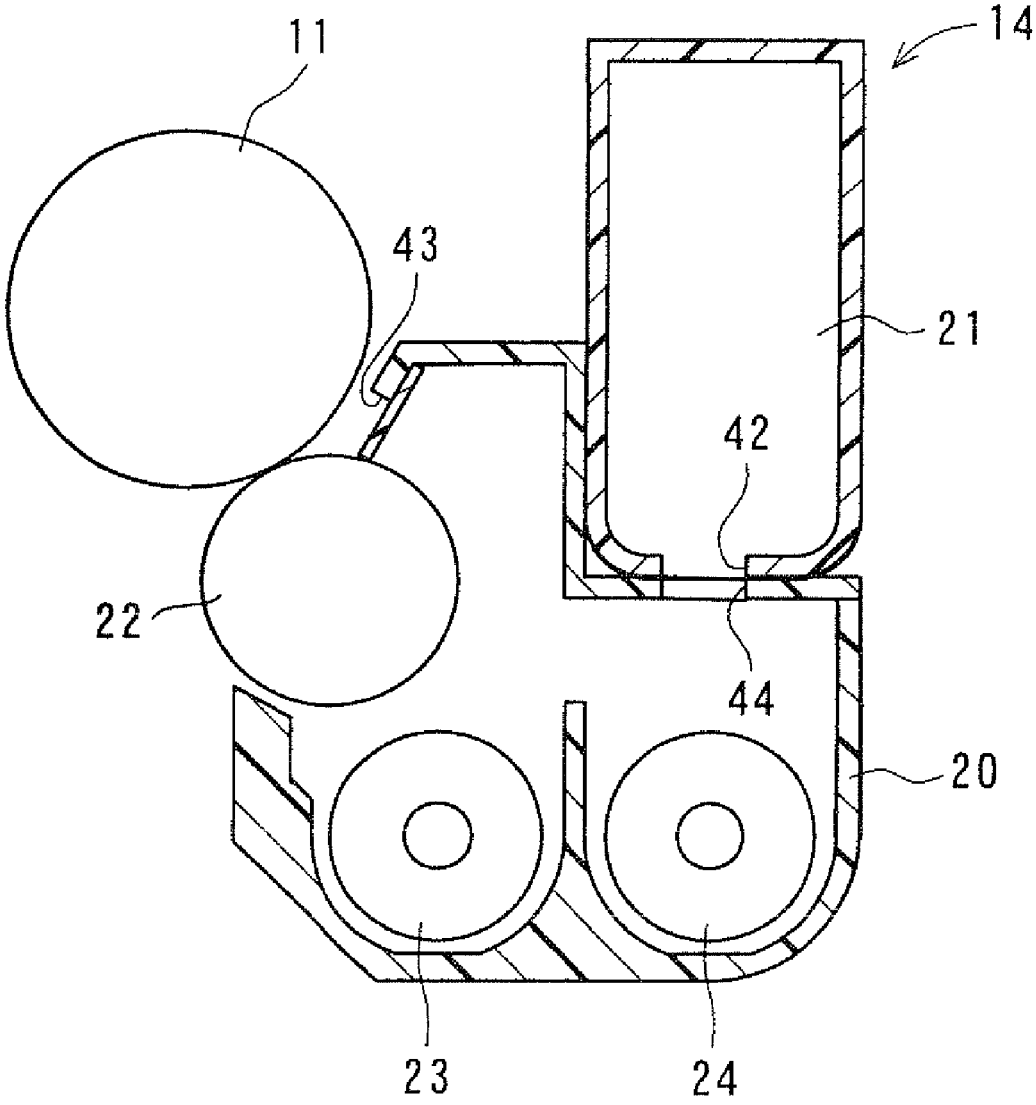
FIG. 3 is a schematic sectional view schematically showing a configuration of a developing device.

FIG. 3 is a schematic sectional view schematically showing a configuration of the developing device 14. The developing device 14 forms a toner image by developing an electrostatic latent image formed on the image hearing member. The developing section 14 includes a developer tank 20 and a toner hopper 21. The developer tank 20 is a container-shaped member which is disposed so as to face the surface of the photoreceptor drum 11 and used to supply the toner to the electrostatic latent image formed on the surface of the photoreceptor drum 11 so as to develop the electrostatic latent image into a visualized image, i.e. the toner image. The developer tank 20 contains in an internal space thereof the developer, and rotatably supports roller members such as a developing roller 22, a supplying roller 23, and an agitating roller 24 or screw members, which members are contained in the developer tank 20. The developer tank 20 has an opening 43 in a side face thereof opposed to the photoreceptor drum 11. The developing roller 22 is rotatably provided at a position where the developing tank 20 faces the photoreceptor drum 11 through the opening 43 just stated. The developing roller 22 is a roller-shaped member for supplying the toner to the electrostatic latent image on the surface of the photoreceptor drum 11 at a pressure-contact portion and most-adjacent portion between the developing roller 22 and the photoreceptor drum 11

In supplying the toner, to a surface of the developing roller 22 is applied a potential whose polarity is opposite to polarity of a potential of the charged toner, which serves as a development bias voltage. By so doing, the toner on the surface of the developing roller 22 is smoothly supplied to the electrostatic latent image. Furthermore, an amount of the toner being supplied to the electrostatic latent image (a toner attachment amount) can be controlled by changing a value or the development bias voltage. The supply roller 23 is a roller-shaped member which is rotatably disposed opposite to the developing roller 22 and used to supply the toner to the vicinity of the developing roller 22. The agitating roller 24 is a roller-shaped member which is rotatably disposed opposite to the supplying roller 23 and used to feed to the vicinity of the supplying roller 23 the toner which is newly supplied from the toner hopper 21 into the developer tank 20. The toner hopper 21 is disposed so as to communicate a toner replenishment port 42 formed in a lower part in a vertical direction thereof, with a toner reception port 44 formed in an upper part in a vertical direction of the developer tank 20. The toner hopper 21 replenishes the developer tank 20 with the toner according to toner consumption. Further, it may be possible to adopt such a configuration that the developer tank 20 is replenished with the toner supplied directly from a toner cartridge of each color without using the toner hopper 21.

In this way, the developing device according to the invention develops an electrostatic latent image by using the developer according to the invention, so that external additive can be prevented from attaching a carrier and a charging member and favorable toner images can be stably formed on a photoreceptor. Accordingly, it is possible to stably form favorable images with no fogging on a none image part over a long period of time. Further, the image forming apparatus according to the invention is achieved including an image bearing member onto which the electrostatic latent image is formed, an electrostatic latent image forming section for forming the electrostatic latent image on the image bearing member, and the developing device according to the invention which device can form favorable toner images as described above. By forming images with the use of such an image forming apparatus, favorable images with no fogging or fixing failure can be stably formed over a long period of time.

EXAMPLES

Each property in Examples and Comparative examples is measured as follows.

(Glass Transition Temperature (Tg) of Binder Resin)

Using a differential scanning calorimeter: DSC220 (trade name, manufactured by Seiko Instruments & Electronics Ltd.), 1 g binder resin was heated at a temperature of which increase rate was 10° C./min based on Japanese Industrial Standards (JIS) K7121-1987, thus obtaining a DSC curve. A straight line was drawn toward a low-temperature side extendedly from a base line on the high-temperature side of an endothermic peak corresponding to glass transition of the DSC curve which had been obtained as above, and a tangent line was also drawn at a point where a gradient thereof was maximum with respect to the curve extending from a rising part to a top of the peak. A temperature at an intersection of the straight line and the tangent line was determined as the glass transition temperature (Tg) of the binder resin.

(Softening Temperature (Tm) of Binder Resin)

An apparatus for evaluating flow characteristics: Flow tester CFT-100C (trade name, manufactured by Shimadzu Corporation), was set such that 1 g of binder resin would he pushed out of a die (1 mm in nozzle aperture and 1 mm in length) under load of 10 kgf/cm$^2$ ($9.8\times10^5$ Pa) with a weight. Using the apparatus, the binder resin was heated at a temperature of which increase rate was 6° C./min, and a temperature of the hinder resin at the time when a half of the binder resin had flowed out of the die was determined as the softening temperature (Tm) of the binder resin.

(Melting Temperature of Release Agent)

Using the differential scanning calorimeter: DSC220 (trade name, manufactured by Seiko Instruments & Electronics Ltd.), an operation of heating 1 g of release agent from a temperature of 20° C. up to 200° C. at a temperature of which increase rate was 10° C./min, and then rapidly cooling down the release agent from 200° C. to 20° C. was repeated twice, thus obtaining a DSC curve. A temperature obtained at a top of an endothermic peak which corresponds to the melting shown on the DSC curve obtained at the second operation, was determined as the melting point of the release agent.

(Average Particle Size of Fine Resin Particle)

Using a real surface view microscope: VE-9800 (trade name, Keyence Co., Ltd.), Fine resin particles of a material of a shell layer were enlarged at 20,000-fold magnification so as to calculate an average particle size of the fine resin particles.

(Volume Average Particle Size of Toner and Coefficient of Variation (CV))

To 50 ml of electrolyte: ISOTON II (trade name, manufactured by Beckman Coulter, Inc.) were added 20 mg of toner and 1 mg of sodium alkyl ether sulfate, which were then subjected to a dispersion treatment at an ultrasonic frequency of 20 kHz for three minutes by an ultrasonic dispersion apparatus: UH-50 (trade name, manufactured by STM Corporation), thereby preparing a measurement sample. The measurement sample was analyzed by a particle size distribution-measuring apparatus: Multisizer III (trade namer manufactured by Beckman Coulter, Inc.) under the conditions that an aperture diameter was 100 μm and the number of particles for measurement was 50,000 counts. A volume particle size distribution of the toner was thus obtained from which the volume average particle size of the toner and a standard deviation in the volume particle size distribution were then determined. A coefficient of variation (CV value, %) was calculated in the following formula (1):

$$\text{CV value (\%)} = (\text{Standard deviation in volume particle size distribution}/\text{Volume average particle size}) \times 100 \quad (1)$$

(Shape Factor SF-2 of Toner)

Toner dispersion liquid was prepared by adding 2.0 g of toner, 1 ml of sodium alkyl ether sulfate and 50 ml of purified water into an 100 ml beaker and stirring them well. The toner dispersion liquid was further dispersed by an ultrasonic homogenizer (manufactured by Nippon Seiki Co., Ltd.) at an output of 50 μA for 5 minutes. After supernatant solution was removed from the liquid that had been left for 6 hours, 50 ml of purified water was added and stirring was carried out for 5 minutes by a magnetic stirrer, and subsequently suction filtration was performed by using a membrane filter (1 μm core diameter). Washed substance remained on the membrane filter was vacuum-dried in a desiccator containing silica gel over night so as to obtain target toner.

On surfaces of toner particles washed in this way, metal film (an Au film whose thickness was 0.5 μm) was formed by sputter deposition Among the metal film-covered toner, 200 to 300 particles were randomly picked up to be photographed by a scanning electron microscope (trade name: S-570, manufactured by Hitachi, Ltd.) at 5 kV accelerating voltage and at 1,000-fold magnification. This electron microscope-photographed data was image analyzed by an image analysis software (trade name: A-ZO-KUN, manufactured by Asahi Kasei Engineering Corporation), from which the shape factor SF-2 was calculated.

(BET Specific Surface Area of Toner)

The BET specific surface area was measured by the BET three-points method, in which a gradient A was obtained from an adsorbed amount of nitrogen with respect to three points of relative pressure, and a value of the specific surface area is obtained from the BET formula, with the use of a specific surface area and fine pore distribution-measuring apparatus: NOVAe 4200e (trade name, manufactured by Yuasa Ionics Inc.).

(Coverage of Shell Layer)

The toner particle was embedded in epoxy resin curable at room temperature, resulting in a cured product which was then cut at plural positions by a microtome with diamond knives, thereby being formed into ultrathin slices each having a thickness of about 100 nm. These ultrathin slices were then stained with ruthenium, thereby a cross-section of the toner particle was photographed at 20,000-fold magnification by a transmission electron microscope (TEM): H-8100 (trade name, manufactured by Hitachi, Ltd.).

The shell layer was stained so that film state is clearly recognized, thereby a core particle was distinguishable from the shell layer. Accordingly, by using an image analysis software to analyze an image photographed, a peripheral length and a length of a covered portion of the toner were measured so as to obtain a coverage of the shell layer.

Hereinafter, the invention will be described more in detail with reference to Examples and Comparative examples.

Example 1

<Cone Particle Preparation Step>

Raw material monomer was synthesized with the aid of catalyst to obtain polyester resin. The raw material monomer was specifically 400 parts by weight of polyoxypropylene (2.0)-2,2-bis(4-hydroxyphenyl)propane, 380 parts by weight of polyoxyethylene(2.0)-2,2-bis(4-hydroxyphenyl)propane, and 330 parts by weight of terephthalic acid. The catalyst was specifically 3 parts by weight of dibutyltin oxide. The polyester resin thus obtained had a glass transition temperature (Tg) of 64° C. and a softening temperature (Tm) of 105° C. And then, as a colorant, copper phthalocyanine (C.I. pigment blue 15:3) was added to the polyester resin. A thus-obtained material was melt-kneaded for 40 minutes by a kneader set at 140° C. As a result, a master batch was obtained whose colorant concentration was 40%. Note that polyoxypropylene (2.0)-2,2-bis(4-hydroxyphenyl)propane was adduct in which 2.0 mol of propylene oxide was added on average to 1.0 mol of 2,2-bis(4-hydroxyphenyl)propane, and polyoxyethylene (2.0)-2,2-bis(4hydroxyphenyl)propane was adduct in which 2.0 mol of ethylene oxide was added on average to 1.0 mol of 2,2-bis(4-hydroxyphenyl)propane.

Next, the following materials were mixed and dispersed by a Henschel mixer for three minutes: 79.5 parts by weight of the polyester resin (having a glass transition temperature (Tg) of 64° C. and a softening temperature of 105° C.) which was the same as that used for the master batch; 1.5 parts by weight of the master batch (having colorant concentration of 40%) prepared as above; and 8 parts by weight of release agent, i.e. carnauba wax (having a melting temperature of 82° C.). A raw material was thus obtained. Using a twin-screw extruder: PCM-30 (trade name, manufactured by Ikegai, Ltd.), the raw material was then melt-kneaded and dispersed, resulting in a resin kneaded material. A toner kneaded material thus obtained was then cooled down by a cooling belt and coarsely pulverized by a speed mill having a screen of 2 mm in diameter.

A coarsely-pulverized material thus obtained was then pulverized by an I-type jet mill and furthermore cleared of dust-size particles and coarse particles by using an elbow jet classifier, resulting in core particles whose volume average particle size was 6.9 μm.

<Shell Layer Material Preparation Step>

As the fine resin particles, fine particles of styrene-butyl acrylate copolymer were prepared which had a volume average particle size of 0.15 μm and a glass transition temperature of 70° C. Moreover, ethanol was prepared as the adhesion aiding agent.

<Coating Step>

Into a surface-modifying apparatus in which a two-fluid nozzle for atomizing liquid into the apparatus was provided, 100 parts by weight of the core particles and 10 parts by weight of the fine resin particles were put and left for 10 minutes at the number of revolutions of 8,000 rpm and at a temperature of 55° C. in the apparatus. Note that the surface-modifying apparatus was specifically HYBRIDIZATION SYSTEM NHS-1 (trade name, manufactured by Nara Machinery Co., Ltd), Subsequently, the two-fluid nozzle was adjusted so that compressed air was fed thereto to atomize ethanol, which served as the adhesion aiding agent, at a rate of 0.5 g/min. The atomization then continued for 30 minutes, thereby coating the entire surfaces of the core particles with the resin film. Mixed materials thus obtained were further kept being rotated for ten minutes so that the ethanol was dried.

The core particles were thus obtained, in which the above coating formed of the fine resin particles became shell layers which covered the entire surfaces of the core particles.

<External Addition Step>

With 100 parts by weight of the toner particles obtained as described above, 2.0 parts by weight of silica particles were mixed, which silica particles had an average primary particle size of 20 nm and had been hydrophobically treated with silica coupling agent. Note that a Henschel-typo mixing apparatus was used for the external addition in which a circumferential velocity was 35 m/s and a mixing time was three minutes.

Example 2

A toner according to Example 2 was obtained in the same manner as Example 1 except that a temperature in the surface-modifying apparatus was changed from 55° C. to 60° C. at the coating step.

Example 3

A toner according to Example 3 was obtained in the same manner as Example 1 except that the number of revolutions of the surface-modifying apparatus was changed from 6,000 rpm to 7,500 rpm at the coating step.

Example 4

A toner according to Example 4 was obtained in the same manner as Example 1 except that an amount of addition of silica particles having an average primary particle size of 20 nm and having been hydrophobically treated with silane coupling agent with respect to 100 parts by weight of toner particles was changed from 2.0 parts by weight to 0.6 part by weight at the external addition step.

Example 5

A toner according to Example 5 was obtained in the same manner as Example 1 except that an amount of addition of silica particles having an average primary particle size of 20 nm and having been hydrophobically treated with silane coupling agent with respect to 100 parts by weight of toner particles was changed from 2.0 parts by weight to 3.0 parts by weight at the external addition step.

Example 6

A toner according to Example 6 was obtained in the same manner as Example 1 except that an input of fine resin particles was changed from 10 parts by weight to 5 parts by weight at the coating step.

Example 7

A toner according to Example 7 was obtained in the same manner as Example 1 except that silica particles having an average primary particle size of 4 nm and having been hydrophobically treated with silane coupling agent were used, instead of the silica particles used in Example 1 at the external addition step.

Example 8

A toner according to Example 8 was obtained in the same manner as Example 1 except that silica particles having an average primary particle size of 8 nm and having been hydrophobically treated with silane coupling agent were used, instead of the silica particles used in Example 1, at the external addition step.

Example 9

A toner according to Example 9 was obtained in the same manner as Example 1 except that silica particles having an average primary particle size of 200 nm and having been hydrophobically treated with silane coupling agent were used, instead of the silica particles used in Example 1, at the external addition step.

Example 10

A toner according to Example 10 was obtained in the same manner as Example 1 except that silica particles having an average primary particle size of 220 nm and having been hydrophobically treated with silane coupling agent were used, instead of the silica particles used in Example 1, at the external addition step.

Example 11

A toner according to Example 11 was obtained in the same manner as Example 1 except that core particles whose volume average particle size was 6.5 μm and whose shape factor SF-2 was 127 were used, which core particles were prepared as follows.

<Core Particle Preparation Step>

Resin solution having a solid content of 35% by weight was prepared by dissolving and suspending the resin kneaded material obtained at the core particle preparation step according to Example 1 in methyl ethyl ketone.

Further, a water dispersion of calcium carbonate was prepared, which was aqueous vehicle having calcium carbonate concentration of 30%, by dispersinlg 30 parts by weight of calcium carbonate: LUMINUS (trade name, manufactured by Maruo Calcium Co., Ltd.) having a primary particle size of 0.1 μm and 70 parts by weight of water. 143 g of the resin solution (50 g of a solid content) and 250 g of the water dispersion of calcium carbonate (75 g of a solid content) were put in a mixing container provided with a rotor-stator type agitator and a temperature regulator and agitated for 20 minutes at 20° C. in a solution. An agitation velocity at this time was set at 8,000 revolutions per minute (8,000 rpm). Thereafter, the agitation was stopped and mixed liquid was transferred to a vacuum pressure distillation apparatus installing an input valve. After organic solvent or methyl ethyl ketone was distilled off by vacuum pressure distillation, calcium carbonate was entirely degraded and removed from surfaces of colorant-containing resin particles by adding 1N hydrochloric acid solution in order to adjust pH of slurry to 1, and then washing was performed as follows. The washing was repeatedly performed until an electric conductivity of supernatant solution was 10 μS/cm or less, which supernatant solution was obtained by mixing the slurry and water in which a solid content was 10%, agitating mixture with the use of a turbine type agitating blade at 300 revolutions or minute (300 rpm) for 30 minutes, and then centrifuging thee mixture. Thereafter, by centrifugation the solid content was sorted and dried in order to obtain core particles.

Comparative Example 1

A toner according to Comparative example 1 was obtained in the same manner as Example 1 except that after preparing the core particles according to Example 1, the shell layer material preparation step and the coating step were not performed but the external addition step was performed.

Comparative Example 2

A toner according to Comparative example 2 was obtained in the same manner as Example 1 except that a temperature in the surface-modifying apparatus was changed from 55° C. to 70° C. at the coating step.

Comparative Example 3

A toner according to Comparative example 3 was obtained in the same manner as Example 1 except that the number of revolutions of the surface-modifying apparatus was changed from 8,000 rpm to 4,000 rpm at the coating step.

Comparative Example 4

A toner according to Comparative example 4 was obtained in the same manner as Example 1 except that an amount of addition of silica particles having an average primary particle size of 20 nm and having been hydrophobically treated with silane coupling agent with respect to 100 parts by weight of toner particles was changed from 2.0 parts by weight to 0.3 part by weight at the external addition step.

Comparative Example 5

A toner according to Comparative example 5 was obtained in the same manner as Example 1 except that an amount of addition of silica particles having an average primary particle size of 20 nm and having been hydrophobically treated with silane coupling agent with respect to 100 parts by weight of toner particles was changed from 2.0 parts by weight to 4.0 parts by weight at the external addition step.

Comparative Example 6

A toner according to Comparative example 6 was obtained in the same manner as Example 1 except that a temperature in the surface-modifying apparatus was changed from 55° C. to 40° C. at the coating step and an amount of addition of silica particles having an average primary particle size of 20 nm and having been hydrophobically treated with silane coupling agent with respect to 100 parts by weight of toner particles was changed from 2.0 parts by weight to 4.0 parts by weight at the external addition step.

Comparative Example 7

A toner according to Comparative example 7 was obtained in the same manner as Example 11 except that a temperature in the surface-modifying apparatus was changed from 55° C. to 35° C. at the coating step.

Table 1 collectively shows properties of the toners of Examples 1 to 11 and Comparative examples 1 to 7.

TABLE 1

| | Core particle | Toner particle | External additive | | Toner | |
|---|---|---|---|---|---|---|
| | Shape factor SF-2 | Coverage of shell layer | Additive amount (part by weight) | Average primary particle size (nm) | Shape factor SF-2 | BET specific surface area ($m^2/cm^3$) |
| Ex. 1 | 148 | 80% or more | 2 | 20 | 131 | 2.35 |
| Ex. 2 | 148 | 80% or more | 2 | 20 | 122 | 2.29 |
| Ex. 3 | 148 | 80% or more | 2 | 20 | 140 | 2.4 |
| Ex. 4 | 148 | 80% or more | 0.6 | 20 | 131 | 1.37 |
| Ex. 5 | 148 | 80% or more | 3 | 20 | 131 | 3.71 |
| Ex. 6 | 148 | Less than 80% | 2 | 20 | 131 | 2.4 |
| Ex. 7 | 148 | 80% or more | 2 | 4 | 131 | 3.91 |
| Ex. 8 | 148 | 80% or more | 2 | 8 | 131 | 3.7 |
| Ex. 9 | 148 | 80% or more | 2 | 200 | 131 | 1.3 |
| Ex. 10 | 148 | 80% or more | 2 | 220 | 131 | 1.21 |
| Ex. 11 | 127 | 80% or more | 2 | 20 | 121 | 2.2 |
| Comp. Ex. 1 | 148 | — | 2 | 20 | 148 | 2.41 |
| Comp. Ex. 2 | 148 | 80% or more | 2 | 20 | 118 | 2.22 |
| Comp. Ex. 3 | 148 | 80% or more | 2 | 20 | 145 | 2.6 |
| Comp. Ex. 4 | 148 | 80% or more | 0.3 | 20 | 131 | 1.15 |
| Comp. Ex. 5 | 148 | 80% or more | 4 | 20 | 131 | 4.02 |
| Comp. Ex. 6 | 148 | 80% or more | 4 | 20 | 118 | 3.92 |
| Comp. Ex. 7 | 127 | 80% or more | 2 | 20 | 118 | 2.15 |

<Preparation of Two-Component Developer>

As a carrier, a ferrite core carrier having a volume average particle size of 50 μm was used. Two-component developers containing the toners according to Examples 1 to 11 and Comparative examples 1 to 7 were prepared by mixing the toner and the carrier for 40 minutes in a V-type mixer: V-5 (trade name, manufactured by Tokuju Corporation) such that a coverage of the toners according to Examples 1 to 11 and Comparative examples 1 to 7 with respect to the carrier was 60%, respectively.

The toners and the two-component developers obtained in Examples 1 to 11 and Comparative examples 1 to 7 were evaluated in the following methods.

[Flowability]

Evaluation of flowability of the toners according to Examples 1 to 11 and Comparative examples 1 to 7 was carried out based on JIS K-5101-12-1 by using a bulk density measuring equipment (manufactured by Tsutsui Scientific Instruments Co, Ltd.). The more a value of bulk density ($g/cm^3$) is, the better flowability is.

Evaluation of flowability was carried out according to the following criteria.

Good: Favorable. A value of bulk density is 0.370 $g/cm^3$ or more.

Available: Slightly defective. A value of bulk density is 0.350 $g/cm^3$ or more and less than 0.370 $g/cm^3$.

Poor: Defective. A value of bulk density is less than 0.350 $g/cm^3$.

[Life Stability]

The two-component developers according to Examples 1 to 11 and Comparative examples 1 to 7 were put in a commercial copier having a two-component development system: MX-4500N (trade name, manufactured by Sharp Corporation) which idled for three minutes at room temperature and normal humidity. The two-component developers were then collected and an initial amount of charges therein was measured by a suction-type charge amount analyzer: 210H-2A Q/M Meter (trade name, manufactured by TREK, INC.). Subsequently, at room temperature and normal humidity, solid images are printed on 50,000 sheets by the above copier. And then, the two-component developers were collected and an amount of charges therein was measured in the same manner.

Life stability was evaluated based on a difference $\Delta Q_1$ (μC/g) between the initial amount of charges and the charge amount after 50,000 copies were made.

Evaluation was carried out according to the following criteria.

Good: Favorable. A difference $\Delta Q_1$ is 5 μC/g or less. ($5 \geqq |\Delta Q_1|$)

Available: No problem for practical use. A difference $\Delta Q_1$ is above 5 μC/g and 7 μC/g or less. ($7 \geqq |\Delta Q_1| \geqq 5$)

Poor: Defective. A difference $\Delta Q_1$ is above 7 μC/g. ($|\Delta Q_1| \geqq 7$)

[Fogging]

The two-component developers according to Examples 1 to 11 and Comparative examples 1 to 7 were put in a commercial copier having a two-component development system: MX-4500N (trade name, manufactured by Sharp Corporation), and solid images were thereby printed on 50,000 sheets at room temperature and normal humidity. And then, fogging density, namely a difference between a degree of whiteness (WB value) on non-image parts after 50,000 copies were made and a degree of whiteness of a recording medium before copies were made, was obtained by using a calorimeter: Color Meter ZE2000 (trade name, manufactured by Nippon Denshoku Industries Co., Ltd.), which fogging density was a criteria of fogging occurrence. The lower the value is, the less fogging is.

Evaluation of fogging was carried out according to the following criteria.

Good: Favorable. Fogging density is below 0.5.

Available: No problem for practical use. Fogging density is 0.5 or more and less than 1.5.

Poor: Defective. Fogging density is 1.5 or more.

[Fixing Property]

The two-component developers of Examples 1 to 11 and Comparative examples 1 to 7 were loaded in a developing device installed in a test printer which had beer obtained by removing a fixing device from a commercial copier: MX-4500N (trade name, manufactured by Sharp Corporation). By using the test printer, a rectangular solid image part having a length of 20 mm and a width of 50 mm was formed, though not fixed, on an A4-sized recording sheet defined by Japanese Industrial Standards (JIS) P0138, adjusting the amount of attachment of toner thereto to 0.5 mg/cm$^2$. The not-yet fixed toner image thus formed was then fixed by an external fixing machine onto the recording sheet which was fed at a speed of 120 mm/sec, thereby forming an image for evaluation.

As the external fixing machine, an oil-less fixing device was taken out of a commercially-available full-color copier: LIBRE AR-C260 (trade name, manufactured by Sharp Corporation, and adapted so that a surface temperature of a heating roller could be set at a given degree).The oil-less fixing device herein means a fixing device which performs a fixing operation by a heating roller not coated with release agent such as silicone oil.

Images were formed by using the heating roller whose surface temperature was sequentially rising by 5° C. from 130° C. to 220° C. By doing so, fixing property was evaluated by locating the non-offset region where neither of the phenomena arose: low-temperature offset phenomenon that no toner image was fixed onto the recording sheet; nor high temperature offset phenomenon that a toner image was transferred from the heating roller onto the white background part of the recording sheet which part should be a blank. The non-offset region was determined from a difference in temperature between a minimum fixing temperature (° C.) that was the lowest temperature of the heating roller at which the low-temperature offset phenomenon did not appear and a maximum fixing temperature (° C.) that was the highest surface temperature of the heating roller at which the high-temperature offset phenomenon did not appear.

Evaluation of fixing property was carried out according to the following criteria.

Good: Favorable. Non-offset region ranges over a temperature of 30° C. or higher.

Available: No problem for practical use. Non-offset region ranges over a temperature of 20° C. or higher and lower than 30° C.

Poor: Defective. Non-offset region ranges below a temperature lower than 20° C.

[Cleaning Property]

By using the two-component developers according to Examples 1 to 11 and Comparative examples 1 to 7, charts were continuously printed on 1,000 sheets. The charts were 5% in print ratio. The surface of the photoreceptor was then checked with eyes whether or not filming appeared thereon in order to evaluate cleaning property. As a copier, the copier used in evaluation of fixing property was also used herein.

Evaluation of cleaning property was carried out according to the following criteria.

Good: Favorable. No filming appears.

Poor: Defective. Some filming appears.

[Comprehensive Evaluation]

On the basis of the evaluation results obtained as above, comprehensive evaluation was carried out according to the following criteria.

Good: Favorable. No "Available" or "Poor" was given in any of the evaluation results.

Available: No problem for practical use. "Available" was given but no "Poor" was given in any of the evaluation results.

Poor: Defective. "Poor" was given in any of evaluation results.

Table 2 summarizes the evaluation results and the comprehensive evaluation results of the toners according to Examples and Comparative examples.

TABLE 2

| | Flowability | | Life stability | | Fogging | | Fixing property | | | |
|---|---|---|---|---|---|---|---|---|---|---|
| | Value of bulk density (g/cm$^3$) | Evaluation | Difference $\Delta Q_1$ (μC/g) | Evaluation | Fogging Density | Evaluation | Non-offset region (° C.) | Evaluation | Cleaning property Evaluation | Comprehensive Evaluation |
| Ex. 1 | 0.4 | Good | 4 | Good | 0.4 | Good | 40 | Good | Good | Good |
| Ex. 2 | 0.4 | Good | 4 | Good | 0.4 | Good | 40 | Good | Good | Good |
| Ex. 3 | 0.4 | Good | 5 | Good | 0.4 | Good | 40 | Good | Good | Good |
| Ex. 4 | 0.36 | Available | 4 | Good | 0.4 | Good | 40 | Good | Good | Available |
| Ex. 5 | 0.42 | Good | 6 | Available | 0.5 | Available | 25 | Available | Good | Available |
| Ex. 6 | 0.36 | Available | 6 | Available | 0.5 | Available | 40 | Good | Good | Available |

TABLE 2-continued

| | Flowability | | Life stability | | Fogging | | Fixing property | | | |
|---|---|---|---|---|---|---|---|---|---|---|
| | Value of bulk density ($g/cm^3$) | Evaluation | Difference $\Delta Q_1$ ($\mu C/g$) | Evaluation | Fogging Density | Evaluation | Non-offset region (° C.) | Evaluation | Cleaning property Evaluation | Comprehensive Evaluation |
| Ex. 7 | 0.36 | Available | 5 | Good | 0.4 | Good | 30 | Good | Good | Available |
| Ex. 8 | 0.38 | Good | 4 | Good | 0.4 | Good | 30 | Good | Good | Good |
| Ex. 9 | 0.37 | Good | 4 | Good | 0.4 | Good | 40 | Good | Good | Good |
| Ex. 10 | 0.36 | Available | 6 | Available | 0.5 | Available | 40 | Good | Good | Available |
| Ex. 11 | 0.43 | Good | 4 | Good | 0.4 | Good | 30 | Good | Good | Good |
| Comp. Ex. 1 | 0.34 | Poor | 9 | Poor | 1.6 | Poor | 45 | Good | Good | Poor |
| Comp. Ex. 2 | 0.40 | Good | 4 | Good | 0.4 | Good | 35 | Good | Poor | Poor |
| Comp. Ex. 3 | 0.34 | Poor | 4 | Good | 0.4 | Good | 35 | Good | Good | Poor |
| Comp. Ex. 4 | 0.34 | Poor | 4 | Good | 0.4 | Good | 40 | Good | Good | Poor |
| Comp. Ex. 5 | 0.39 | Good | 10 | Poor | 1.6 | Poor | 15 | Poor | Good | Poor |
| Comp. Ex. 6 | 0.40 | Good | 10 | Poor | 1.6 | Poor | 15 | Poor | Poor | Poor |
| Comp. Ex. 7 | 0.45 | Good | 4 | Good | 0.4 | Good | 30 | Good | Poor | Poor |

The toners according to Examples 1 to 11 were favorable, which had excellent chargeability, no fogging, end wide non-offset regions. However, as to the toner according to Example 5, a BET specific surface area was relatively so large that external additive fell, and life stability, fogging and fixing property somewhat degraded. Although a BET specific surface area of the toner according to Example 8 was almost the same as that of the toner according to Example 5, an amount of addition of external additive was less and an average primary particle size of external additive was smaller in Example 8 than those in Example 5, and therefore all the results of Example 8 were favorable. As to the toner according to Example 6, although the evaluation results of fixing property and cleaning property were favorable, a coverage of a shell layer was relatively so low that the other evaluation results were somewhat lowered. As to the toner according to Example 7, an average primary particle size of external additive was relatively so small that the external additive was aggregated in a developer tank and thus flowability somewhat degraded. As to the toner according to Example 10, an average primary particle size of external additive was relatively so large that the external additive fell off and the evaluations of flowability, life stability and fogging were somewhat lowered.

As to the toner according to Comparative example 1, a fixing area was broad but flowability was low. Further, a shell layer was not formed so that degradation of chargeability and fogging occurred, and therefore the toner according to Comparative example 1 was inferior to the toners according to Examples. As to the toner according to Comparative example 2, a shape was so spherical that cleaning property was defective. As to the toner according to Comparative example 3, the shape factor SF-2 was so high, and as to the toner according to Comparative example 4, a BET specific surface area was so small, that flowability degraded in both Comparative examples. As to the toner according to Comparative example 5, a BET specific surface area was so large that flowability was favorable but charge stability in life degraded and fogging occurred. As to the toner according to Comparative example 6, the shape factor SF-2 was so small that flowability was favorable, but charge stability in life degraded, fogging occurred and cleaning property was defective. As to the toner according to Comparative example 7, the shape factor SF-2 was so small that flowability and chargeability were favorable but cleaning property was defective.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A toner comprising:

a toner particle including a core particle and a shell layer formed on a surface of the core particle; and an external additive, (1) the shell layer being formed in a film on the surface of the core particle, (2) a shape factor SF-2 being 120 or more and 140 or less, and (3) a BET specific surface area measured by a BET method being 1.2 $m^2/cm^3$or more and 4.0 $m^2/cm^3$ or less, wherein the core particle is manufactured by a kneading and pulverizing method, and the core particle has a shape factor SF-1 of 140 or more and 160 or less.

2. The toner of claim 1, wherein the BET specific surface area is 1.2 $m^2/cm^3$ or more and 3.2 $m^2/cm^3$ or less.

3. The toner of claim 1, wherein the core particle has a shape factor SF-2 of 130 or more and 150 or less.

4. The toner of claim 1, wherein the shell layer is formed on the surface of the core particle within a range of 80% or more and 100% or less of surface area of the core particle.

5. The toner of claim 1, wherein an average primary particle size of the external additive is 5 nm or more and 200 nm or less.

6. A developer comprising the toner of claim 1.

7. The developer of claim 6, further comprising a carrier, the developer constituting a two-component developer.

* * * * *